US009193166B1

(12) United States Patent
Yabuki

(10) Patent No.: US 9,193,166 B1
(45) Date of Patent: Nov. 24, 2015

(54) CARTRIDGE ACCOMMODATING APPARATUS

(71) Applicant: Brother Kogyo Kabushiki Kaisha, Nagoya-shi, Aichi-ken (JP)

(72) Inventor: Tomoyasu Yabuki, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/730,612

(22) Filed: Jun. 4, 2015

(30) Foreign Application Priority Data

Jun. 4, 2014 (JP) ..... 2014-115601

(51) Int. Cl.
*B41J 29/393* (2006.01)
*B41J 2/175* (2006.01)

(52) U.S. Cl.
CPC ..... *B41J 2/1752* (2013.01); *B41J 2/17543* (2013.01)

(58) Field of Classification Search
CPC .... B41J 29/393; B41J 2/17546; B41J 2/0458; B41J 2/0451; B41J 2/2135
USPC ..... 347/19, 84–87
See application file for complete search history.

(56) References Cited

U.S. PATENT DOCUMENTS

2003/0030683 A1* 2/2003 Nojima ..... B41J 2/17509 347/7
2011/0242233 A1* 10/2011 Hirano ..... B41J 2/17523 347/86
2011/0249065 A1 10/2011 Hirano et al.
2011/0267388 A1 11/2011 Ito et al.

FOREIGN PATENT DOCUMENTS

JP 2011/156726 8/2011
JP 2011/235445 11/2011

* cited by examiner

*Primary Examiner* — Manish S Shah
*Assistant Examiner* — Yaovi Ameh
(74) *Attorney, Agent, or Firm* — Frommer Lawrence & Haug LLP

(57) ABSTRACT

A cartridge accommodating apparatus includes: a cartridge accommodating section accommodating a cartridge which includes a liquid accommodating section, a liquid lead-out channel, a first blocking member blocking a first portion of the liquid lead-out channel, and a second blocking member blocking a second portion between the first portion and the liquid accommodating section; a hollow tube introducing liquid in the liquid lead-out channel into inside of the hollow tube; a moving mechanism moving the hollow tube between a first position at which a tip portion of the hollow tube is located outside the liquid lead-out channel and a second position at which the tip portion of the hollow tube has entered inside the liquid lead-out channel; a driving source; a driving force transmitting mechanism transmitting driving force of the driving source to the moving mechanism; and a driving source controller controlling driving speed of the driving source.

12 Claims, 12 Drawing Sheets

CARTRIDGE ACCOMMODATING APPARATUS

CROSS REFERENCE TO RELATED APPLICATION

The present application claims priority from Japanese Patent Application No. 2014-115601 filed on Jun. 4, 2014 the disclosure of which is incorporated herein by reference in its entirety.

BACKGROUND OF THE INVENTION

1. Field of the Invention

The present invention relates to a cartridge accommodating apparatus capable of accommodating a cartridge which accommodates liquid.

2. Description of the Related Art

There is known an ink-jet printer including an installing section (cartridge accommodating section) configured such that an ink cartridge can be installed therein. Specifically, the ink cartridge to be installed in the installing section is provided with an ink accommodating section (liquid accommodating section) in which ink is accommodated, an ink lead-out tube (liquid lead-out channel) communicated with the ink accommodating section, and first and second valves (first and second blocking members) disposed in the ink lead-out tube. The installing section provided on the ink-jet printer includes a hollow needle (hollow tube). Further, by performing an operation for installing the ink cartridge in the installing section, the hollow needle is allowed to enter into the inside of the ink lead-out tube so as to open (release) the first and second valves.

SUMMARY

Instead of the aspect wherein the hollow tube is allowed to enter into the liquid lead-out channel by performing the operation for installing (accommodating) the cartridge in the cartridge installing section, the inventor of the present teaching found out another aspect wherein a hollow tube is allowed to enter into the inside of the liquid lead-out channel by moving the hollow tube itself with respect to a cartridge accommodated in the cartridge accommodating section. Specifically, this aspect found out by the inventor is provided with a moving mechanism capable of moving the hollow tube, a driving source, a driving force transmitting mechanism configured to transmit the driving force of the driving source to the moving mechanism, and a driving source controller configured to control the driving source. Further, by controlling the driving source with the driving source controller, the hollow tube is allowed to enter into the liquid lead-out channel to thereby release the first and second blocking members disposed in the liquid lead-out channel.

Here, the inventor of the present teaching newly found out that regarding the case of driving the driving source at a constant driving speed to cause the hollow tube to enter into the liquid lead-out channel to thereby release the first and second blocking members disposed in the liquid lead-out channel, there is such a problem that the operation sound generated from the driving force transmitting mechanism while the hollow tube is being moved is great at all times.

The present teaching has been made in view of the above-described circumstances; an object of the present teaching is to provide a cartridge accommodating apparatus capable of reducing the operation sound from the driving force transmitting mechanism to be small.

According to an aspect of the present teaching, there is provided a cartridge accommodating apparatus including: a cartridge accommodating section configured to accommodate a cartridge which includes a liquid accommodating section configured to accommodate liquid, a liquid lead-out channel communicated with the liquid accommodating section and configured to lead the liquid to outside of the liquid accommodating section, a first blocking member configured to block a first portion of the liquid lead-out channel, and a second blocking member configured to block a second portion, of the liquid lead-out channel, between the first portion of the liquid lead-out channel and the liquid accommodating section; a hollow tube configured to introduce the liquid, in the liquid lead-out channel of the cartridge, into inside of the hollow tube; a moving mechanism configured to move the hollow tube between a first position at which a tip portion of the hollow tube is located outside the liquid lead-out channel of the cartridge accommodated in the cartridge accommodating section and a second position at which the tip portion of the hollow tube has entered inside the liquid lead-out channel of the cartridge and the hollow tube is communicated with the liquid accommodating section of the cartridge; a driving source; a driving force transmitting mechanism configured to transmit driving force of the driving source to the moving mechanism; and a driving source controller configured to control driving speed of the driving source, wherein the driving source controller is configured to: drive the driving source at a first driving speed, after causing the hollow tube to move from the first position and until judging that the tip portion of the hollow tube has reached a first contact position at which the tip portion of the hollow tube makes contact with the first blocking member; drive the driving source at a second driving speed which is faster than the first driving speed, after judging that the tip portion of the hollow tube has reached the first contact position and until judging that the tip portion of the hollow tube has reached a release position at which the tip portion of the hollow tube releases the first blocking member; and drive the driving source at a third speed, after judging that the tip portion of the hollow tube has reached a second contact position at which the tip portion of the hollow tube makes contact with the second blocking member.

The operation sound from the driving force transmitting mechanism is greater as the driving speed for driving the driving source becomes faster. Here, force required for moving the hollow tube by a unit distance between the first position to the first contact position is smaller than force required for moving the hollow tube by the unit distance between the first contact position to the release position and is smaller than force required for moving the hollow tube by the unit distance between the second contact position to the second position. Further, the force required for moving the hollow tube by the unit distance between the first contact position to the release position and the force required for moving the hollow tube by the unit distance between the second contact position to the second position depend on resistance forces received by the hollow tube from the first and second blocking members when the hollow tube releases the first and second blocking members, respectively. Thus, in the present teaching, the first driving speed for driving the driving source, during a certain period after the hollow tube is moved from the first position and until a judgment is made that the hollow tube has reached the first contact position, is made to be slower than the second driving speed for driving the driving source during another period after the judgement is made that the tip portion of the hollow tube has reached the first contact position and until a judgement is made that the tip portion of the hollow tube has reached the release position. By doing so, it is possible to reduce the operation sound generated from the driving force transmitting mechanism to be small during the certain period of time. Furthermore, by setting appropriately each of the second driving speed at which the driving source is driven during another period of time after judging that the hollow tube has reached the first contact position and until judging that the hollow tube has reached the release position, and the third driving speed at which the driving source is driven during yet another period of time after judging that the hollow tube has reached the second contact position, it is possible to reduce the operation sound generated from the driving force transmitting mechanism during any one of these periods of time to be small, in some cases.

BRIEF DESCRIPTION OF THE DRAWINGS

FIGS. 10A to 10C each depict a partial cross sectional view of a hollow tube and a cartridge according to a modified embodiment, wherein FIG. 10A depicts a state that the hollow tube is arranged at a first contact position, FIG. 10B depicts a state that the hollow tube is arranged at a release position, and FIG. 10C depicts a state that the hollow tube is arranged at a second contact position.

DESCRIPTION OF THE EMBODIMENTS

Figure 1:
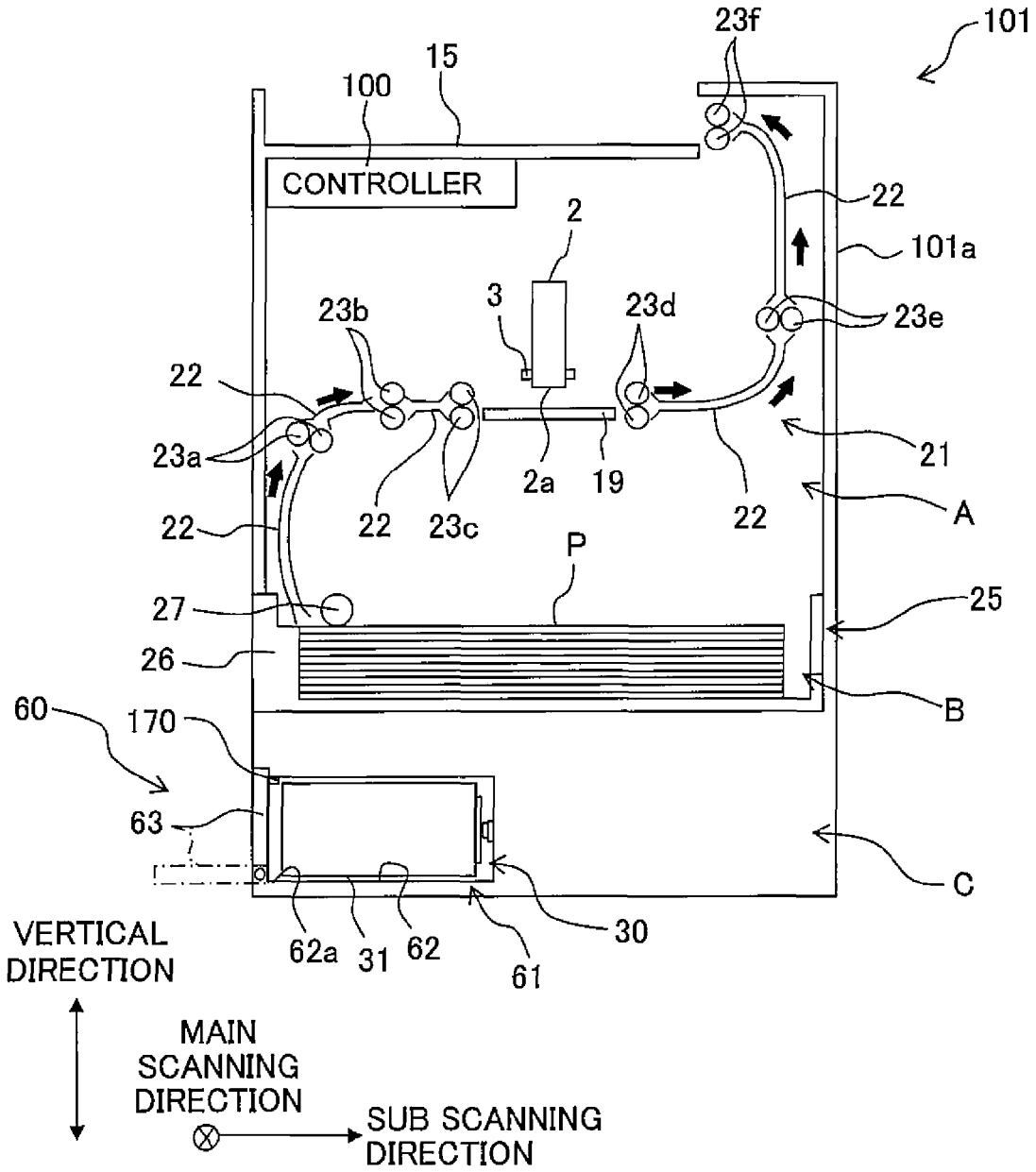
FIG. 1 is a schematic configuration diagram of an ink-jet printer provided with a cartridge accommodating apparatus according to an embodiment of the present teaching.

An ink-jet printer 101 (hereinafter referred to as the "printer 101") provided with a cartridge accommodating apparatus 60 according to an embodiment of the present teaching has a casing 101*a* having a rectangular parallelepiped shape, as depicted in FIG. 1. A paper discharge section 15 is disposed on the top plate of the casing 101*a*. Further, the inside of the casing 101*a* is divided into three spaces A, B and C in this order from above. An ink-jet head 2 configured to jet black ink, a conveyance mechanism 21 configured to convey a paper P, and a controller 100 configured to control the entire operation of the printer 101 are arranged in the space A. A paper feeding mechanism 25 configured to supply the paper P is arranged in the space B, and a cartridge accommodating apparatus 60 capable of accommodating a cartridge 30 is arranged in the space C.

The ink-jet head 2 (hereinafter referred to as the "head 2") extends in a main scanning direction, and is supported by the casing 101*a* via a frame 3. Namely, the printer 101 is a monochrome ink-jet printer of the line system. The head 2 has a stacked body constructed by adhering or joining a channel unit and an actuator to each other, wherein the channel unit has ink channels including pressure chambers formed therein, and the actuator is configured to apply pressure to the ink inside the pressure chambers. Further, the bottom surface of the head 2 is a jetting surface 2*a* in which a plurality of discharge ports via which the ink is jetted are formed. The head 2 is connected to a flexible tube (not depicted in the drawings) communicated with the ink channels formed inside the head 2. The tube is connected to an ink supply path 64 (to be described later on; see FIG. 3). In this embodiment, a sub scanning direction is a direction parallel to a conveyance direction in which the paper P is conveyed by nip rollers 23*c* and 23*d* of a conveying mechanism 21 (to be described later on). Further, in this embodiment, the main scanning direction is a direction orthogonal to the sub scanning direction and along a horizontal plane (i.e. orthogonal to the sub scanning direction and a vertical direction).

The paper feeding mechanism 25 has a paper feeding tray 26 capable of accommodating a plurality of sheets of the paper P therein, and a paper feeding roller 27 attached to the paper feeding tray 26. The paper feeding roller 27 is rotated when a paper feeding motor 126 (see FIG. 6) is driven under the control of the controller 100 to thereby feed out a sheet of the paper P, among the plurality of sheets of the paper P, which is located at the uppermost position in the paper feeding tray 26.

The conveyance mechanism 21 includes a guide 22 and nip rollers 23*a* to 23*f*. The guide 22 defines a conveyance path of the paper P starting from the paper feeding mechanism 25, passing between the head 2 and a platen 19 and arriving at the paper discharge section 15. The nip rollers 23*a* to 23*f* are arranged along the conveyance path. The nip rollers 23*a* to 23*f* are rotated when a conveyance motor 125 (see FIG. 6) is driven under the control of the controller 100 so as to apply the conveyance force to the paper P fed out by the paper feeding mechanism 25. When the paper P conveyed by the conveyance mechanism 21 passes a space between the jetting surface 2*a* of the head 2 and the platen 19, the ink is jetted from the jetting ports of the head 2 under the control by the controller 100, thereby forming a desired monochrome image on the paper P. The paper P, having the image formed thereon, is conveyed further by the conveyance mechanism 21 and is discharged to the paper discharge section 15.

Figure 2A:
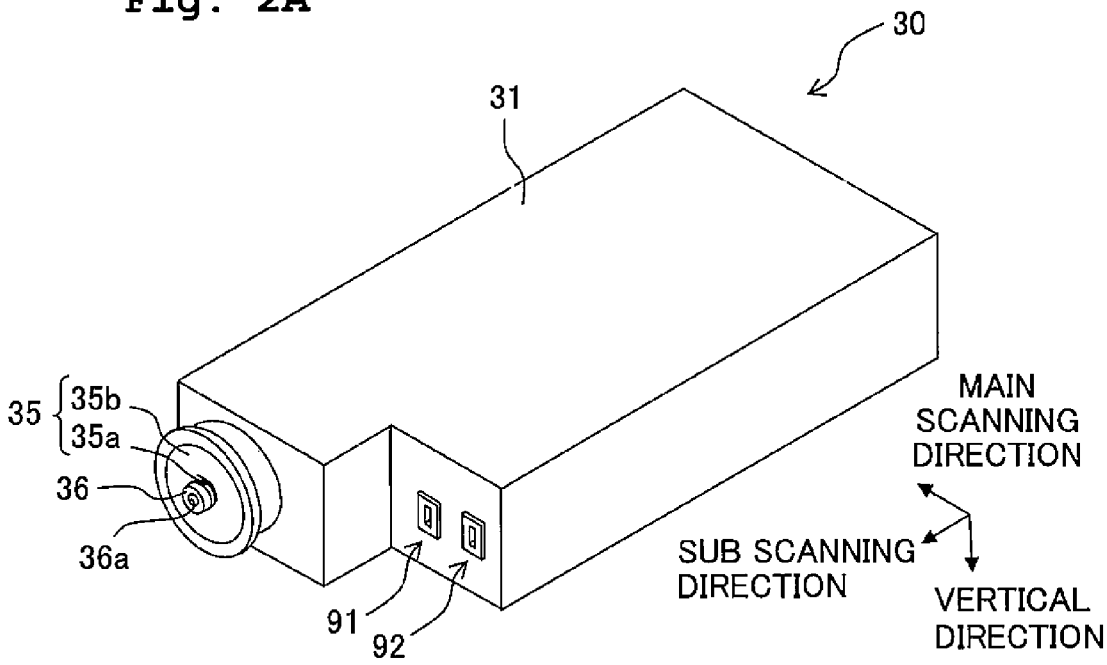
FIG. 2A is a perspective view of a cartridge which can be accommodated in a cartridge accommodating section depicted in FIG. 1.
Figure 2B:
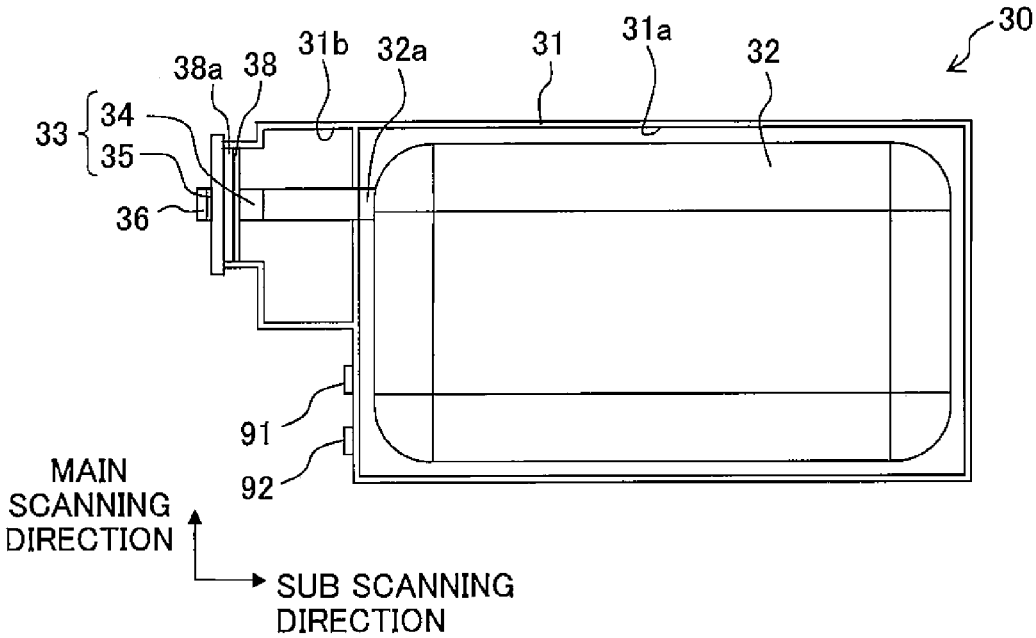
FIG. 2B is a schematic configuration diagram of inside of the cartridge.

Next, before the cartridge accommodating apparatus 60 is explained, the cartridge 30 configured to be accommodated in an attachable/detachable manner with respect to the cartridge accommodating apparatus 60 will be explained with reference to FIGS. 2A, 2B, 3A to 3C and 6. Note that in FIG. 6, thick lines indicate electric power supply lines, and narrow lines indicate signal lines. As depicted in FIGS. 2A and 2B, the cartridge 30 has a casing 31 having a substantially rectangular parallelepiped shape; an ink bag (liquid accommodating section) 32 which is arranged inside the casing 31 and in which an ink is filled (accommodated or stored); an ink lead-out tube 33 of which one end portion is communicated with the ink bag 32; and a first blocking member 40 (see FIGS. 3A to 3C) and a second blocking member 50 (see FIGS. 3A to 3C).

Figure 3A:
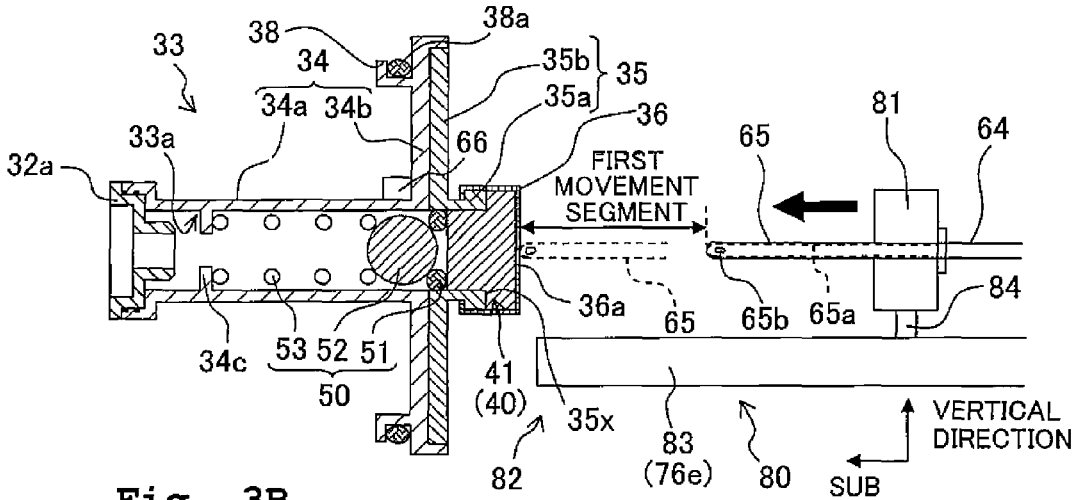
FIG. 3A is a partial cross sectional view of a hollow tube and the cartridge in a state that the hollow tube is arranged at a first position.
Figure 3B:
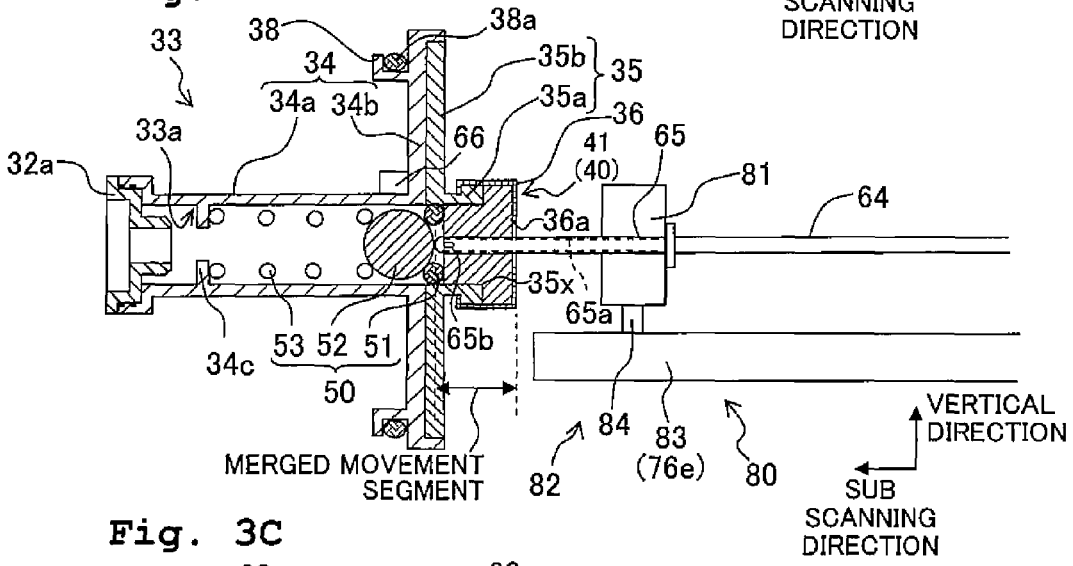
FIG. 3B is a partial cross sectional view of the hollow tube and the cartridge in a state that the hollow tube is arranged at a second contact position.
Figure 3C:
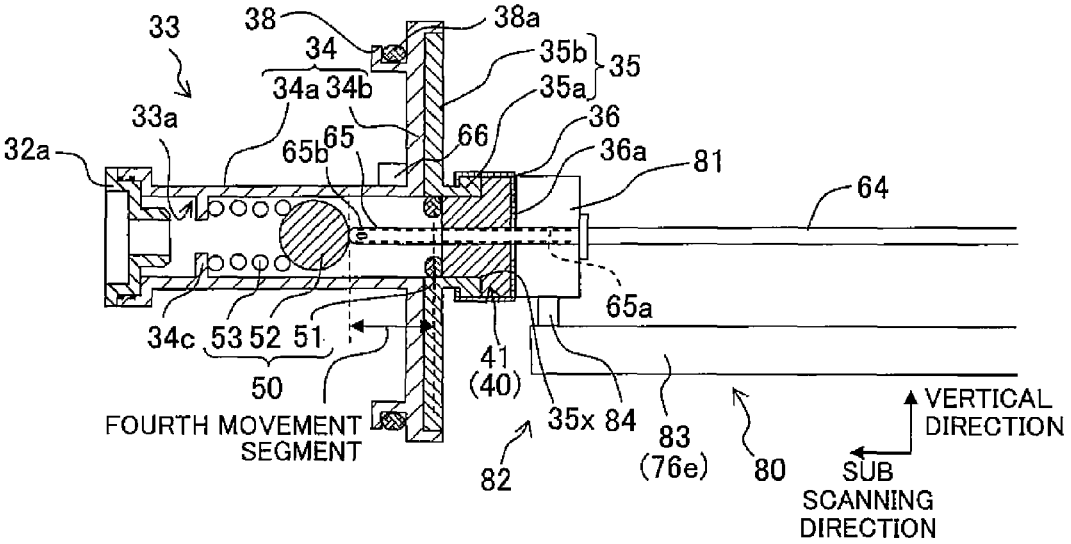
FIG. 3C is a partial cross sectional view of the hollow tube and the cartridge in a state that the hollow tube is arranged at a second position.

As depicted in FIG. 2B, the casing 31 is divided or partitioned such that two chambers 31*a* and 31*b* are formed inside the casing 31. The ink bag 32 is arranged in the chamber 31*a* on one side, and the ink lead-out tube 33 is arranged in the chamber 31*b* on the other side. The ink lead-out tube 33 includes tubes 34 and 35 which are connected to each other. As depicted in FIGS. 3A to 3C, an ink channel (liquid lead-out channel) 33*a* extending in the sub scanning direction and communicated with the ink bag 32 is formed inside the tubes 34 and 35. Namely, the ink channel 33*a* is constructed of two continued spaces that are the space inside the tube 34 and the space inside the tube 35.

The tube 35 includes a main portion 35*a* having a cylindrical shape and extending in the sub scanning direction, and a flange 35*b* having a disc shape with a circular-shaped opening formed at the central portion thereof. The tube 34 has a main portion 34*a* having a cylindrical shape and extending in the sub scanning direction, and a flange 34*b* having a disc shape with a circular-shaped opening formed at the central portion thereof. A connecting section 32*a* is fitted into one end of the main portion 34*a*, and the flange 35*b* of the tube 35 is fitted into the other end of the main portion 34, via the flange 34*b*. The flange 34*b* extends outwardly from the circumferential edge defining the opening at the other end portion of the main portion 34*a*. Further, the flange 34*b* has an annular-shaped projection 38 which is formed in the flange 34*b* and in which an O-ring 38*a* is disposed. As depicted in FIG. 2B, the space between the casing 31 and the annular-shaped projection 38 is sealed by the O-ring 38*a*.

The first blocking member 40 is a member capable of blocking (closing) the ink channel 33*a* at an end portion (first portion) of the main portion 35*a*. As depicted in FIGS. 3A to 3C, the first blocking member 40 includes a plug 41 having a substantially columnar shape. The plug 41 is formed of an elastic material such as a rubber, and is provided in a compressed state such that the plug 41 blocks (closes) an opening 35*x* (lead-out port of the ink channel 33*a*) which is located at the end portion of the main portion 35*a*. The plug 41 includes a portion arranged inside the opening 35*x* and a portion arranged outside the opening 35*x*. A cap 36 is disposed at the end portion of the main portion 35*a* and at the exterior of the plug 41. Since the cap 36 covers the plug 41 fitted into the end portion of the main portion 35*a*, it is possible to prevent the plug 41 from falling or detaching from the main portion 35*a*. Note that an opening 36*a* is formed at the central portion of the cap 36, and an end surface of the plug 41 is exposed via the opening 36*a*.

The second blocking member 50 is a valve member arranged inside the tube 34 and capable of blocking (closing) the ink channel 33*a* inside the tube 34 (second portion). The second blocking member 50 includes an O-ring 51 (valve seat), a valve body 52 and a coil spring 53. The O-ring 51 is formed of an elastic material such as a rubber, and is fixed in a state that the O-ring 51 is brought into contact with the plug 41, in the inner circumferential surface inside the tube 35. The O-ring 51 is interposed between the valve body 52 and the plug 41. The valve body 52 is a spherical body formed of a magnetic material, and has a diameter smaller to some extent than the inner diameter of the tube 34. Further, the valve body 52 is a movable body which is movable along the sub scanning direction inside the tube 34 as a predetermined range between the plug 41 and the ink bag 32. The coil spring 53 has one end making contact with the valve body 52 and the other end making contact with an annular-shaped projection 34*c*, which is formed inside the tube 34 and which projects inwardly from the inner circumferential surface of the tube 34, and the coil spring 53 urges the valve body 52 toward the O-ring 51 at all times. Namely, the coil spring 53 urges the valve body 52 toward the opening 36*a* so that the valve body 52 is brought into contact with the O-ring 51, thereby blocking the communication with the ink channel 33*a*. Namely, the communication between the tubes 34 and 35 is blocked (closed), which in turn brings the second blocking member 50 into a close state.

Note that the elements or components constructing the first and second blocking members 40 and 50 are arranged in a linear manner along the sub scanning direction. Therefore, both of the first and second blocking members 40 and 50 are switched from the close state into the open state by inserting a hollow tube 65 with respect to the cartridge 30 (to be described later on). Further, in the embodiment, the resistance force received by the hollow tube 65 from the first blocking member 40 when the hollow tube 65 releases the first blocking member 40 is greater than the resistance force received by the hollow tube 65 from the second blocking member 50 when the hollow tube 65 releases the second blocking member 50. Namely, force required for moving the hollow tube 65 by a unit distance when allowing the hollow tube 65 to penetrate through the plug 41 of the first blocking member 40 is greater than force required for moving the hollow tube 65 by the unit distance and against the urging force generated by the coil spring 53 in a state that the tip portion of the hollow tube 65 is brought into contact with the valve body 52 of the second blocking member 52.

Regarding the foregoing configuration, in a state that the cartridge 30 is accommodated in the cartridge accommodating apparatus 60, when the hollow tube 65 is moved by a moving mechanism 80 along the sub scanning direction toward the cartridge 30 (as will be described later on), the hollow tube 65 penetrates through a substantially central portion of the plug 41 via the opening 36*a* in the sub scanning direction (see FIG. 3B). At this time, the first blocking member 40 is switched from the close state under which the first blocking member 40 blocks (closes) the ink channel 33*a* into the open state under which the first blocking member 40 opens (releases) the ink channel 33*a*. When the first blocking member 40 is in the open state, a hole 65*b* formed at a tip portion of the hollow tube 65 is arranged inside the ink channel 33*a*, and a hollow portion 65*a* defined inside the hollow tube 65 communicates with a portion, of the ink channel 33*a*, located between the second blocking member 50 and the first blocking member 40, via the hole 65*b*. Note that when a portion, of the hollow tube 65, in which the hole 65*b* is formed penetrates through the plug 41, the hollow tube 65 is allowed to communicate with the ink channel 33*a*. However, until the second blocking member 50 is brought into the open state, the ink inside the ink bag 32 does not inflow into the hollow portion 65*a*. Further, in this situation, a through hole is formed in the plug 41 by being penetrated with the hollow tube 65, a portion of the plug 41 surrounding the through hole makes tight contact with the outer circumferential surface of the hollow tube 65 by the elasticity of the plug 41, thereby preventing the ink from leaking between the through hole of the plug 41 and the hollow tube 65.

Afterwards, the tip portion of the hollow tube 65 is brought into contact with the valve body 52. Then, when the hollow tube 65 enters further into the ink channel 33*a*, the valve body 52 is pushed and moved by the hollow tube 65, which in turn causes the valve body 52 to be separated away from the O-ring 51. At this time, the second blocking member 50 is switched from the close state to the open state. In a state that the second blocking member 50 is in the open state, a space defined between one end portion of the tube 34 and the O-ring 51 in the ink channel 33*a* and another space defined between the O-ring 51 and the plug 41 in the ink channel 33*a* are communicated with each other, thereby making it possible to lead the ink stored in the ink bag 32 to the outside of the ink bag 32. Namely, as depicted in FIG. 3C, the ink bag 32 and the hollow tube 65 are communicated with each other when both of the first and second blocking members 40 and 50 are in the open state. With this, the ink can be supplied to the head 2.

On the other hand, in a case of removing the cartridge 30 from the cartridge accommodating apparatus 60, when the hollow tube 65 is moved by the moving mechanism 80 along the sub scanning direction in a separating direction separating away from the cartridge 30 (as will be described later on), the valve body 52 is moved in a direction approaching toward the O-ring 51 by the urging force of the coil spring 53. Then, when the valve body 52 is brought into contact with the O-ring 51, the second blocking member 50 is switched from the open state to the close state. Further, when the hollow tube 65 is moved farther in the separating direction away from the cartridge 30, the hollow tube 65 is separated away from the plug 41, thereby blocking the communication between the hollow tube 65 and the ink channel 33*a*. At this time, the through hole of the plug 41 becomes small, due to the elasticity of the portion of the plug 41 surrounding the through hole, to such an extent that the ink is prevented from leaking.

Figure 4A:
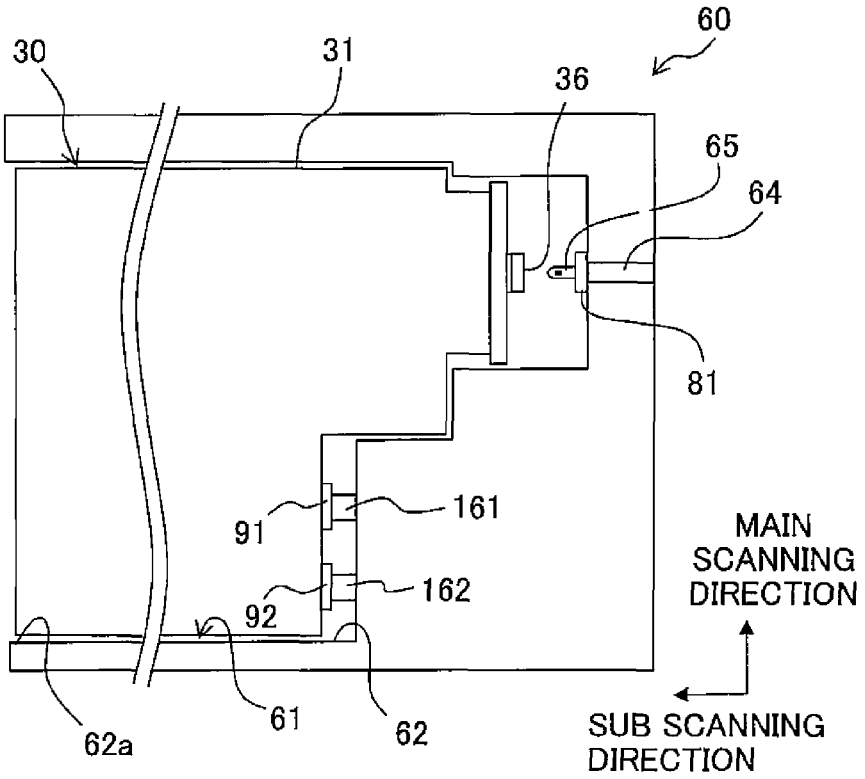
FIG. 4A is a partial plan view of the cartridge in a state that the cartridge is accommodated in the cartridge accommodating section.
Figure 6:
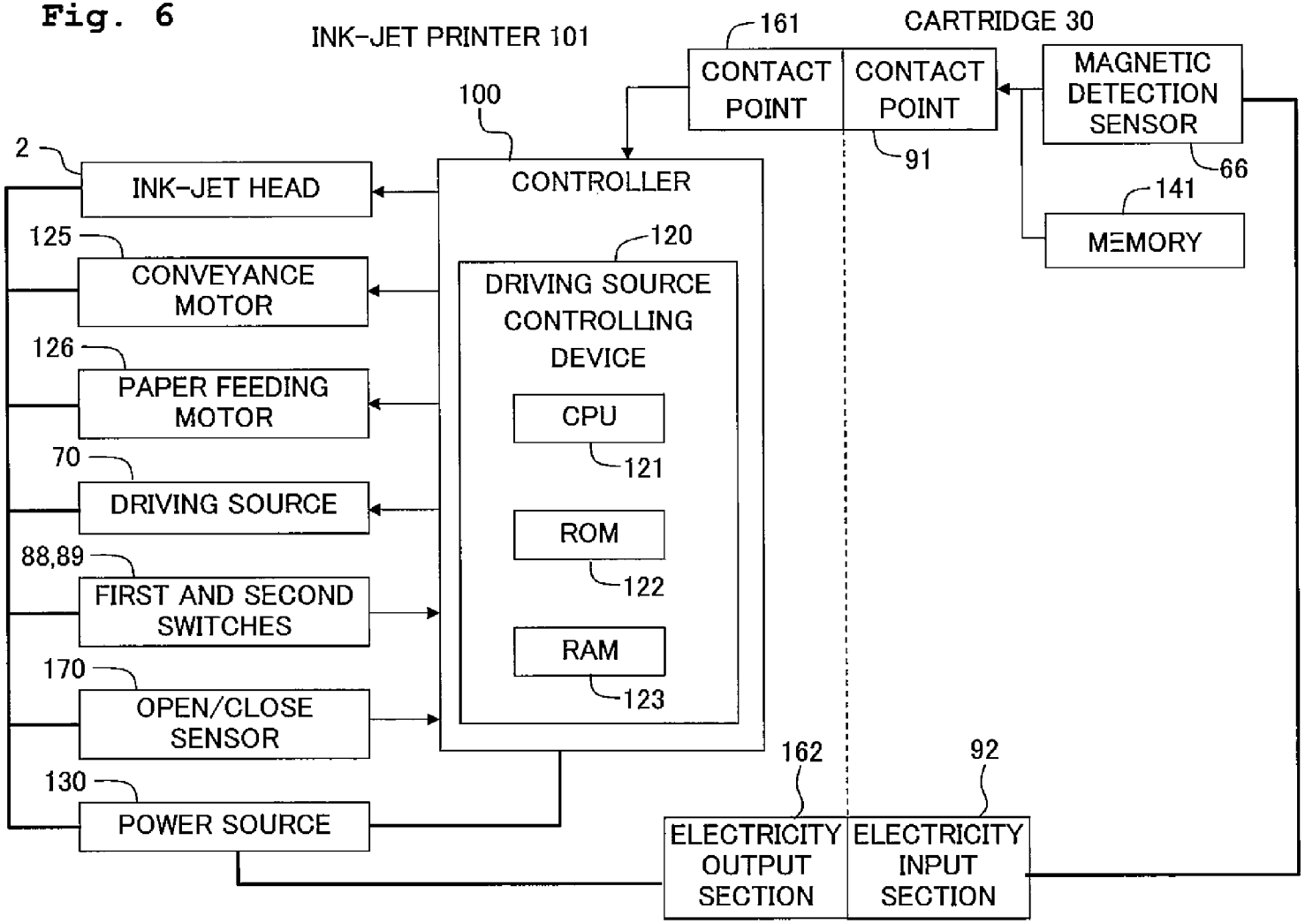
FIG. 6 is a block diagram depicting the electric configurations of the ink-jet printer and cartridge.

As depicted in FIG. 4A, a contact point 91 and an electricity input section 92 are provided on a side surface, of the chamber 31*a*, on the side closer to the opening 36*a* in the casing 31. The contact point 91 is electrically connected to a magnetic detection sensor 66 and a memory 141 (to be described later on), as depicted in FIG. 6. The electricity input section 92 is electrically connected to the magnetic detection sensor 66 and the memory 141, and supplies the electricity to the magnetic detection sensor 66 and the memory 141 by being electrically connected to an electricity output section 162 (to be described later on).

Further, the magnetic detection sensor 66, connected to the contact point 91, is disposed in the chamber 31*b* of the casing 31 (see, for example, FIGS. 2B and 3A to 3C). The magnetic detection sensor 66 is constructed of a Hall element, and is driven at a voltage based on a signal transmitted from the controller 100 via the contact point 91. As depicted in FIG. 3A, when the valve body 52 makes contact with the O-ring 51 to bring the second blocking member 50 into the close state, the strength of the magnetic field detected by the magnetic detection sensor 66 is great, and the magnetic detection sensor 66 outputs, to the controller 100, a signal indicating a greatest voltage value (hereinafter referred to as the "maximum voltage value"; 3.3 V in the embodiment). As depicted in FIG. 3C, when the valve body 52 is moved leftward to be separated away from the O-ring 51 and as the distance between the valve body 52 and the magnetic detection sensor 66 is greater, the strength of the magnetic field detected by the magnetic detection sensor 66 becomes smaller, which in turn also causes the voltage value indicated by the signal outputted from the magnetic detection sensor 66 to be smaller. As a modified example, it is allowable to provide such a configuration wherein the magnetic detection sensor 66 outputs a signal indicating a smallest voltage value to the controller 100 when the valve body 52 makes contact with the O-ring 51, and that the voltage value indicated by the signal outputted from the magnetic detection sensor 66 becomes greater as the valve body 52 is separated away from the O-ring 51 and is moved leftward as depicted in FIG. 3C. As described above, the voltage value indicated by the signal outputted from the magnetic detection sensor 66 is proportional to the strength of the magnetic field which changes depending on the distance between the magnetic detection sensor 66 and the valve body 52 as the detection target, and the controller 100 is capable of judging regarding the position of the valve body 52 based on the voltage value received from the magnetic detection sensor 66. Note that in the embodiment, information regarding the maximum voltage value is stored in advance in a RAM 123 of the controller 100.

Figure 4B:
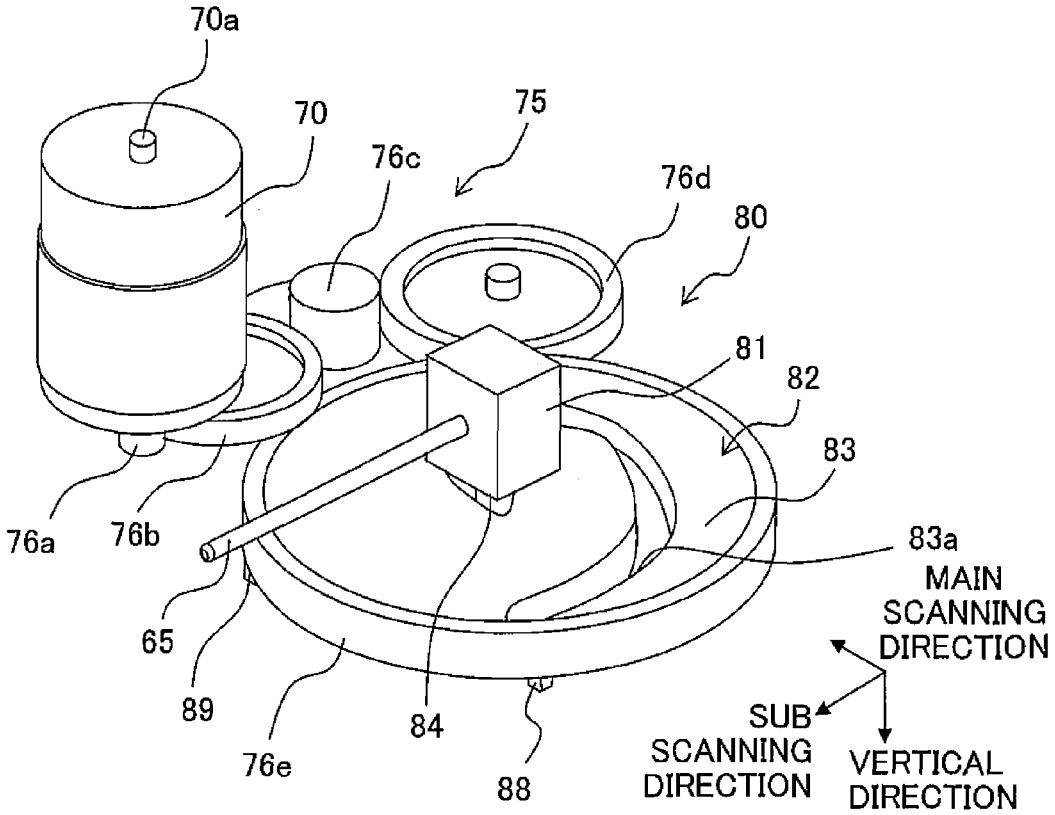
FIG. 4B is a perspective view depicting a moving mechanism configured to move the hollow tube and a driving force transmitting mechanism configured to transmit the driving force of a driving source to the moving mechanism.

Next, an explanation will be given about the cartridge accommodating apparatus 60 with reference to FIGS. 1, 4A, 4B, 5A and 5B. As depicted in FIGS. 4A and 4B, the cartridge accommodating apparatus 60 includes a cartridge accommodating section 61, the hollow tube 65, a driving source 70, the driving force transmitting mechanism 75, the moving mechanism 80, and a driving source controlling device 120 (an example of the driving source controller; see FIG. 6). The cartridge accommodating section 61 has a recessed portion 62 capable of accommodating the cartridge 30 therein, and a cover 63. An opening 62*a* of the recessed portion 62 is an insertion port (insertion opening) into which the cartridge 30 is inserted. The printer 101 of this embodiment is configured such that the insertion and removal (detachment) of the cartridge 30 relative to the cartridge accommodating section 61 is performed in the sub scanning direction.

The cover 63 is configured to be openable/closable, with the horizontal shaft at a lower end portion of the opening 62*a* as the fulcrum (rocking shaft). The opening/closing operation of the cover 63 is executed by a user. Note that in order to exchange the cartridge 30, the user may open the cover 63 and remove the cartridge 30 from the cartridge accommodating section 61, and then may install a new cartridge 30 to the cartridge accommodating section 61. Further, an open/close sensor 170 connected to the controller 100 (driving source controlling device 120) is disposed in the opening 62*a* of the recessed portion 62. The open/close sensor 170 is a mechanical switch which detects the opening/closing of the cover 63 based on whether or not the open/close sensor 170 makes contact with the cover 63, and the open/close sensor 170 outputs a signal indicating a result of detection to the controller 100. By receiving the signal from the open/close sensor 170, the controller 100 can detect the opening/closing of the cover 63.

As depicted in FIG. 4A, a contact point 161 electrically connected to the controller 100, and an electricity output section 162 configured to output the electricity from a power source 130 (see FIG. 6) disposed on the body of the printer 101 are disposed in the vicinity of a bottom portion of the recessed portion 62. The power source 130 is disposed inside the casing 101*a* and supplies the electricity to the respective parts or components of the printer 101. The contact point 161 is arranged at a position facing the contact point 91, and is electrically connected to the contact point 91 when the cartridge 30 is installed in the cartridge accommodating section 61. With this, a signal can be transmitted and received between the cartridge 30 and the printer 101. The electricity output section 162 is arranged at a position facing the electricity input section 92, and is electrically connected to the electricity input section 92 when the cartridge 30 is installed in the cartridge accommodating section 61, in a similar manner regarding the contact point 161. With this, the electricity is supplied from the power source 130 to the magnetic detection sensor 66 and the memory 141 via the electricity output section 162 and the electricity input section 92.

The hollow tube 65 is a tube configured to introduce, to an ink supply path 64, the ink accommodated in the ink bag 32 of the cartridge 30. As depicted in FIGS. 3A to 3C, the hollow tube 65 extends in the sub scanning direction and is arranged at a position facing the ink lead-out tube 33 of the cartridge 30. The hollow tube 65 has a hollow portion 65*a* formed in the hollow tube 65 and communicating with the ink supply path 64, and a hole 65*b* formed in the hollow tube 65 in the vicinity of a tip portion of the hollow tube 65 and communicating the hollow portion 65*a* with the outside of the hollow tube 65.

The driving source 70 is a driving motor capable of rotating in the normal and reverse directions as depicted in FIG. 4B, and the rotational direction and driving speed of the driving motor 70 are controlled by the driving source controlling device 120. The driving force transmitting mechanism 75 is a mechanism configured to transmit the driving force of the driving source 70 to the moving mechanism 80, and is provided with gears 76*a* to 76*e*. The gear 76*a* (first gear) is a motor pinion gear connected to a rotation shaft 70*a* of the driving source 70. The gear 76*b* is directly meshed with the gear 76*a*, the gear 76*c* is directly meshed with the gear 76*b*, the gear 76*d* is directly meshed with the gear 76*c*, and the gear 76*e* (second gear) is directly meshed with the gear 76*d*. Namely, the gear 76*e* is indirectly meshed with the gear 76*a* via the gears 76*b* to 76*d*. Accordingly, when the driving source 70 is driven, the driving force of the driving source 70 is transmitted to the gear 76*e* via the gears 76*a* to 76*d*, thereby rotating the gear 76*e*.

The moving mechanism 80 is a mechanism configured to move the hollow tube 65 between a first position (see FIG. 3A) and a second position (see FIG. 3C) in the sub scanning direction, and the moving mechanism 80 is provided with a supporting body 81 and a converting mechanism 82. The first position is a position at which the tip portion of the hollow tube 65 is located at the outside of the ink channel 33*a* of the cartridge 30 accommodated in the cartridge accommodating section 61, and the second position is a position at which the tip portion of the hollow tube 65 has entered into the inside of the ink channel 33*a* and the hollow tube 65 is communicated with the ink bag 32 of the cartridge 30. The supporting body 81 is configured to support the hollow tube 65 and is guided by a regulating member (not depicted in the drawings) so that the supporting member 81 is movable only along the sub scanning direction.

Figure 5A:
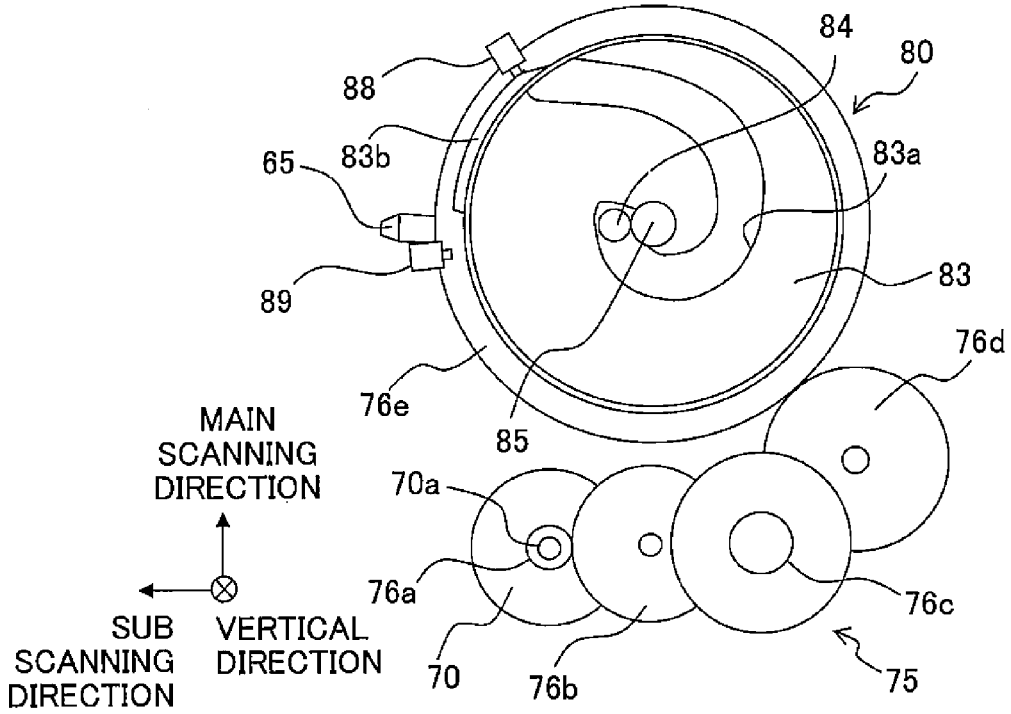
FIG. 5A is a bottom view of the moving mechanism and the driving force transmitting mechanism in a state that a rotating cam is located at an origin position.
Figure 5B:
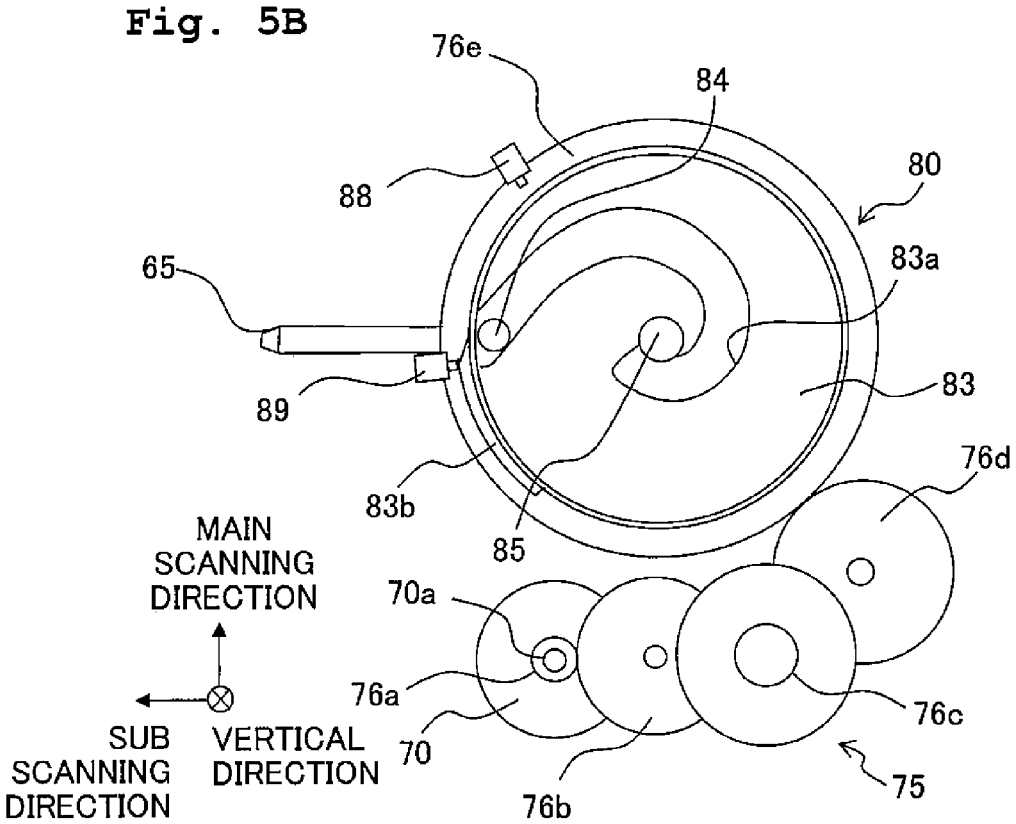
FIG. 5B is a bottom view of the moving mechanism and the driving force transmitting mechanism in a state that the rotating cam is located at a maximally rotated position.

The converting mechanism 82 is a mechanism configured to convert the rotating operation of the gear 76*e* into a linear operation so as to move the supporting body 81 along the sub scanning direction. The converting mechanism 82 is provided with a rotating cam 83 which is arranged inside the gear 76*e*, and a slider 84 of which upper end portion is fixed to the lower surface of the supporting member 81. The rotating cam 83 has a rotation shaft 85 that is coaxial with the rotation shaft of the gear 76*e* as depicted in FIGS. 5A and 5B, and the rotating cam 83 is rotated together with the rotation of the gear 76*e*. The rotating cam 83 has a cam groove 83*a* to which the slider 84 is engaged. The cam groove 83*a* has a base end portion located at the circumferential edge of the rotation shaft 85, and a distal end portion located on the side of the outer circumferential surface of the rotating cam 83 father from the base end portion, and is extended in a spiral form around the rotating shaft 85 from the base end portion toward the distal end portion.

In a state that the rotating cam 83 is located at a position depicted in FIG. 5A (hereinafter referred to as the "origin position"), the slider 84 is engaged with or fitted to the base end portion of the cam groove 83*a*. At this situation, the hollow tube 65 is arranged at the first position (see FIG. 3A). Namely, in this state, the tip portion of the hollow tube 65 is arranged at the outside of the ink channel 33*a* in the cartridge 30 accommodated in the cartridge accommodating section 61, and the first and second blocking members 40 and 50 are in the close state closing the ink channel 33*a*. Namely, the ink bag 32 and the hollow tube 65 are not communicated with each other.

When the driving source 70 is driven from the state depicted in FIG. 5A so as to rotate the gear 76*e*, the rotating cam 83 is rotated clockwise, then the slider 84 receives a force from the inner surface of the cam groove 83*a*, which in turn causes the slider 84 (supporting body 81) to move leftward in FIGS. 5A and 5B. Accompanying with this, the hollow tube 65 is moved from the first position toward the second position. Then, in a state that the rotating cam 83 is located at the position depicted in FIG. 5B (hereinafter referred to as a "maximally rotated position"), the slider 84 is engaged with (fitted to) the distal end portion of the cam groove 83*a*. In this situation, the hollow tube 65 is arranged at the second position (see FIG. 3C). Namely, in this state, the tip portion of the hollow tube 65 has entered into the inside of the ink channel 33*a* of the cartridge 30 accommodated in the cartridge accommodating section 61, and the first and second blocking members 40 and 50 are brought into the release state releasing the ink channel 33*a*. Namely, the ink bag 32 is allowed to communicate with the hollow tube 65. Further, when the rotating cam 83 is rotated counterclockwise from the state that the rotating cam 83 is located at the maximally rotated position, the hollow tube 65 is consequently moved from the second position toward the first position. In the following description, a rotation direction of the driving source 70 for rotating the rotating cam 83 in the clockwise direction is referred to as "normal direction", and a rotation direction of the driving source 70 for rotating the rotating cam 83 in the counterclockwise direction is referred to as "reverse direction".

The cartridge accommodating apparatus 60 has a first switch 88 for detecting the origin position of the rotating cam 83, and a second switch 89 for detecting the maximally rotated position of the rotating cam 83. Further, the rotating cam 83 has a projection 83*b* disposed on the outer circumferential portion thereof and provided for operating the first and second switches 88 and 89. In a state that the rotating cam 83 is located at a certain angle position, the first switch 88 is brought into an ON state by being contacted with the projection 83*b* of the rotating cam 83 and the second switch 89 is brought into an OFF state by being separated away from (not being contacted by) the projection 83*b* of the rotating cam 83. On the other hand, in a state that the rotating cam 83 is located at another angle position, the first switch 88 is brought into the OFF state by being separated away from the projection 83*b* of the rotating cam 83 and the second switch 89 is brought into the ON state by being contacted with the projection 83*b* of the rotating cam 83. In this embodiment, setting is made such that at the angle position of the rotating cam 83 with which the first switch 88 is in the ON state, the rotation cam 83 is located at the origin position, namely the hollow tube 65 is located at the first position. Further, another setting is made such that at the angle position of the rotating cam 83 with which the second switch 89 is in the ON state, the rotation cam 83 is located at the maximally rotated position, namely the hollow tube 65 is located at the second position. Accordingly, the controller 100 (driving source controlling device 120) is capable of recognizing (judging) whether the hollow tube 65 is arranged at the first position or at the second position based on a signal from the first switch 88 and a signal from the second switch 98.

The driving source controlling device 120 is a device configured to control the rotation direction and driving speed of the driving source 70 and is a part of the controller 100. As depicted in FIG. 6, the controller 100 has a CPU (Central Processing Unit) 121 as an arithmetic processing unit, a ROM (Read Only Memory) 122, a RAM (Random Access Memory) 123, and the like. The ROM 122 stores a program executed by the CPU 121, a various kinds of fixed data, etc. The RAM 123 temporarily stores data necessary for executing a program. The controller 100 executes a recording operation (controlling the conveyance motor 125, paper feeding motor 126, head 2, etc.) for recording an image, etc., on a paper P in accordance with a recording instruction from an external apparatus (such as a personal computer, etc.).

Further, the controller 100 executes inserting/removing operations for inserting/removing the hollow tube 65 with respect to the cartridge 30 accommodated in the cartridge accommodating section 61. Specifically, the controller 100 executes the inserting operation for causing the hollow tube 65 to move from the first position to the second position, in a case that the cover 63 is switched from the open state to the close state in a state that the cartridge 30 is accommodated in the cartridge accommodating section 61. In the inserting operation, the controller 100 drives the driving source 70 to rotate in the normal direction until the second switch 89 is switched from the OFF state to the ON state. On the other hand, the controller 100 executes the removing operation for causing the hollow tube 65 to move from the second position to the first position, in a case that the cover 63 is switched from the close state to the open state in the state that the cartridge 30 is accommodated in the cartridge accommodating section 61. In the removing operation, the controller 100 drives the driving source 70 to rotate in the reverse direction until the first switch 88 is switched from the OFF state to the ON state.

Figure 7A:
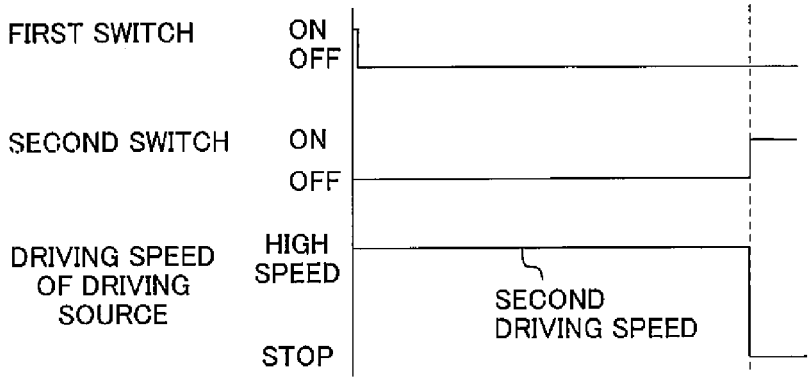
FIG. 7A depicts time charts for a first switch, a second switch and a driving speed for the driving source each in an inserting operation (inserting processing) according to a comparative example.

Here, the inventor of the present teaching found out that, in an aspect for driving the driving source 70 at a constant driving speed in the above-described inserting operation as depicted in FIG. 7A, the operation sound (sound generated by the mutually meshing gears 76*a* to 76*e*) generated from the driving force transmitting mechanism 75, etc. is great at all times. A specified explanation will be given in the following. In the inserting operation for moving the hollow tube 65 from the first position to the second position, the force required for moving the hollow tube 65 by the unit distance is different among segments in the moving range of the hollow tube 65. Specifically, the movement range between the first and second positions can be divided into four movement segments, in accordance with the force required for moving the hollow tube 65 by the unit distance. The four movement segments are: a movement segment (hereinafter referred to as "first movement segment") between the first position and a position at which the tip portion of the hollow tube 65 is brought into contact with the plug 41 of the first blocking member 40 (the position indicated by the chain lines of FIG. 3A: hereinafter referred to as "first contact position"); a movement segment (hereinafter referred to as "second movement segment") between the first contact position and a release position at which the tip portion of the hollow tube 65 releases the plug 41; a movement segment (hereinafter referred to as "third movement segment") between the release position and a position at which the tip portion of the hollow tube 65 is brought into contact with the valve body 52 of the second blocking member 50 (see FIG. 3B: hereinafter referred to as "second contact position); and a movement segment (see FIG. 3C: hereinafter referred to as "fourth movement segment") between the second contact position and the second position.

In the first movement segment, the hollow tube 65 does not make contact with the cartridge 30, and thus the hollow tube 65 does not receive any resistance force from the cartridge 30 when the hollow tube 65 is being moved in this first movement segment. On the other hand, when the hollow tube 65 is being moved in the second to fourth movement segments, the hollow tube 65 makes contact with the cartridge 30, and thus the hollow tube 65 receives the resistance force from the cartridge 30 when the hollow tube 65 is being moved in each of the second to fourth movement segments. Specifically, in the second movement segment, the hollow tube 65 receives resistance force generated when the hollow tube 65 penetrates through the plug 41 of the first blocking member 40; in the third movement segment, the hollow tube 65 receives resistance force due to the friction force between the hollow tube 65 and the plug 41 when the hollow tube 65 passes through the plug 41; and in the fourth movement segment, the hollow tube 65 receives the resistance force due to the friction force between the hollow tube 65 and the plug 41 and receives resistance force generated when the hollow tube 65 causes the valve body 52 of the second blocking member 50 to move against the urging force of the coil spring 53. Note that as described briefly in the foregoing, the resistance force received by the hollow tube 65 from the first blocking member 40 when releasing the first blocking member 40 is greater than the resistance force received by the hollow tube 65 from the second blocking member 50 when releasing the second blocking member 50. Therefore, the second movement segment is a movement segment in which the force required for moving the hollow tube 65 by the unit distance is greatest among the first to fourth movement segments. As described above, since the resistance forces received by the hollow tube 65 from the cartridge 30 are different among the first to fourth movement segments, the forces required for moving the hollow tube 65 by the unit distance are consequently different among the first to fourth movement segments.

Here, in a case of driving the driving source 70 at a constant driving speed during the inserting operation, the driving speed is needed to be set to a high driving speed (hereinafter referred to as "second driving speed") corresponding to the second movement segment, as depicted in FIG. 7A. Therefore, during a period of time in which the hollow tube 65 is moved from the first position to the second position, the driving source 70 is consequently driven at the high, second driving speed, which in turn makes the operation sound from the driving force transmitting mechanism 75 be great at all times. In view of this situation, the present embodiment is configured such that when the controller 100 is executing the inserting operation, the controller 100 judges which movement segment, among the movement segments, the hollow tube 65 is moving in, and changes the driving speed at which the driving source 70 is driven depending on the movement segment in which the hollow tube 65 is currently moving, rather than driving the driving source 70 at any constant driving speed during the inserting operation.

Here, in the embodiment, the third movement segment has a distance which is not more than the thickness in the sub scanning direction of the O-ring 51 of the second blocking member 50, and is quite short as compared with the remaining three movement segments. Namely, the timing at which the hollow tube 65 reaches the releasing position and the timing at which the hollow tube 65 reaches the second contact position are substantially coincident or same. Thus, in the embodiment, a movement segment obtained by merging the second and third movement segments is referred to as a "merged movement segment". Further, in the inserting operation, the controller 100 is configured to judge which movement segment, among the three movement segments that are the first, merged and fourth movement segments, the hollow tube 65 is moving in, and to drive the driving source 70 at one of pre-set driving speeds which have been previously set for the movement segments, respectively.

Figure 7B:
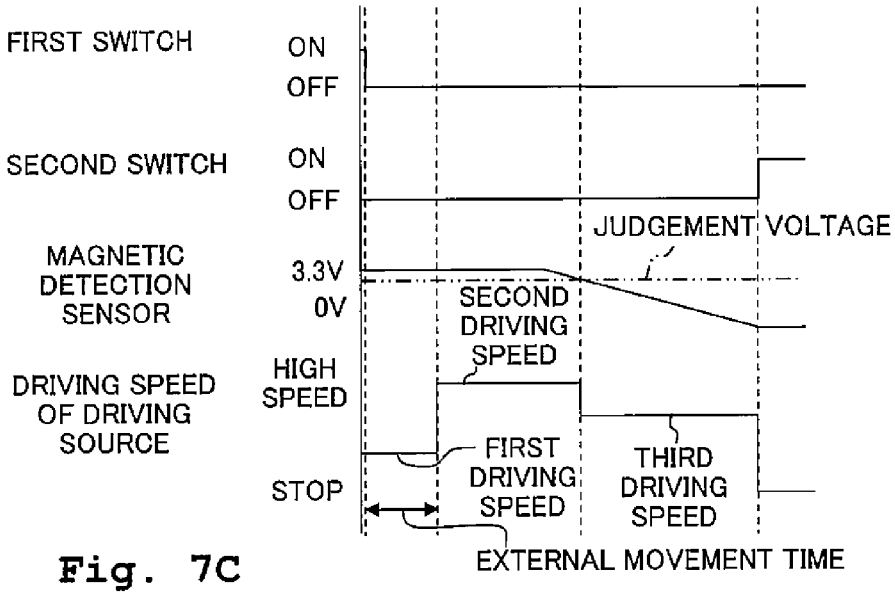
FIG. 7B depicts time charts for the first switch, the second switch, a magnetic detection sensor and the driving speed for the driving source each in an inserting operation according to the embodiment.

Next, an explanation will be given about the driving speeds of the driving source 70 which are set for the first, merged and fourth movement segments, respectively, with reference to FIG. 7B. The driving speed for driving the driving source 70 in the merged movement segment, which includes the second movement segment in which the force required for moving the hollow tube 65 by the unit distance is the greatest, is set to be the above-described second driving speed. Furthermore, the force required for moving the hollow tube 65 by the unit distance in the fourth movement segment is smaller than the force required for moving the hollow tube 65 by the unit distance in the second movement segment. Accordingly, the driving speed for driving the driving source 70 in the fourth movement segment is set to be a third driving speed which is slower than the second driving speed. Moreover, the first movement segment is a segment in which the force required for moving the hollow tube 65 by the unit distance is the smallest among all the movement segments. Accordingly, the driving speed for driving the driving source 70 in the first movement segment is set to be a first driving speed which is slower than the second and third driving speeds.

In the inserting operation, the controller 100 of the embodiment makes the judgment as to whether the hollow tube 65 has reached the first contact position that is the boundary between the first movement segment and the merged movement segment, based on an elapsed time elapsed since the hollow tube 65 has been moved from the first position (since a movement start time: a point of time at which the first switch 88 has switched from the ON state to the OFF state). Specifically, the controller 100 judges that the hollow tube 65 has reached the first contact point at a point of time at which an external movement time (first time or first period of time) has elapsed since the point of time at which the hollow tube 65 started to move from the first position. Note that the term "external movement time" means a time obtained by dividing a control target distance (distance to be controlled) between the first position and the first contact position by a movement speed at which the hollow tube 65 is moved under a condition that the driving source 70 is driven at the first driving speed.

Note that there is any variation or dispersion of first positions and/or first contact positions due to manufacturing errors of the cartridge accommodating apparatuses 60 (printers 101). Similarly, there is any variation of first contact positions due to manufacturing errors of the cartridges 30. As a result, there is any variation of actual distances between the first positions and the first contact positions. Therefore, there is such a possibility that any big or significant difference might be generated between the control target distance between the first position and the first contact position and the actual distance between the first position and the first contact position. Namely, there is such a possibility that any big or significant difference in time might be generated between the time at which the external movement time has elapsed since the movement start time and a time (actual reach time) at which the hollow tube 65 actually reaches the first contact position. Considering this possibility, in the present embodiment, variation (maximum range of dispersion) of the first contact positions presumed at the time of manufacturing the cartridges 30 (hereinafter referred to as "cartridge-side variation") is stored in advance in the memory 141 (an example of the cartridge-side memory) of the cartridge 30. Further, variation (maximum range of dispersion) of the first positions and variation (maximum range of dispersion) of the first contact positions, respectively, presumed at the time of manufacturing the cartridge accommodating apparatuses 60 (hereinafter referred to as "apparatus-side variation(s)") and a designed distance between the first position and the first contact position are stored in advance in the RAM 123 (an example of the cartridge accommodating apparatus-side memory) of the controller 100. Then, in a case that the cartridge 30 is accommodated in the cartridge accommodating section 61, the controller 100 reads the cartridge-side maximum variation stored in the memory 141 via the contact points 91 and 161. The controller 100 determines the above-described control target distance between the first position and the first contact position based on the cartridge-side maximum variation read as described above and based on the apparatus-side maximum variations and the designed distance stored in the RAM 123. Further, the controller 100 calculates the external movement time based on the determined control target distance and the above-described movement speed of the hollow tube 65. By doing so, it is possible to make any time difference between the elapsed time elapsed since the movement start time and the time (actual reach time) at which the hollow tube 65 actually reaches the first contact position be small. Note that the calculated external movement time is stored in the RAM 123.

Further, in the inserting operation, the controller 100 of the embodiment judges whether or not the hollow tube 65 has reached the second contact position (release position) that is the boundary between the merged movement segment and the fourth movement segment, based on a signal received from the magnetic detection sensor 66. As briefly described above, the voltage value indicated by the signal received from the magnetic detection sensor 66 becomes lower as the valve body 52 is separated away from the O-ring 51 and moves leftward in FIGS. 3A to 3C. Namely, the voltage value indicated by the signal received from the magnetic detection sensor 66 changes after the hollow tube 65 has reached the second contact position and has been brought into contact with the valve body 52. Thus, the controller 100 judges that the hollow tube 65 has reached the second contact position, under a condition that the signal received from the magnetic detection sensor 66 has changed from a signal indicating the maximum voltage value to a signal indicating a voltage value which is lower than the maximum voltage value by a predetermined voltage (hereinafter referred to as "judgement voltage value").

Figure 7C:
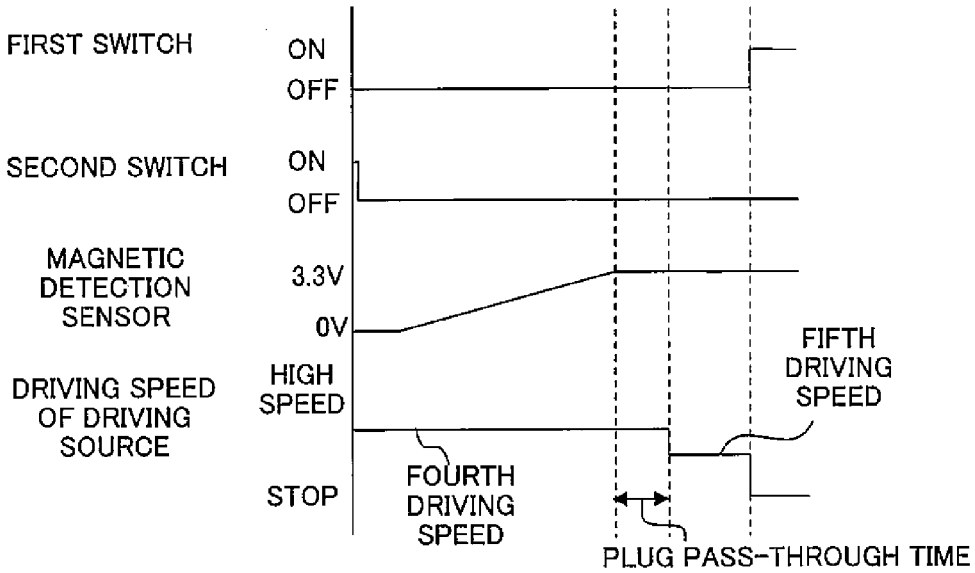
FIG. 7C depicts time charts for the first switch, the second switch, the magnetic detection sensor and the driving speed for the driving source each in a removing operation (removing processing) according to the embodiment.

Further, the inventor of the present teaching found out that also regarding the removing operation for causing the hollow tube 65 to move from the second position to the first position, the operating sound from the driving force transmitting mechanism 75, etc. is always loud at all times, in a case that the driving source 70 is driven at a constant driving speed, similarly with the inserting operation. Specifically, also in the removing operation, the movement range between the first position and the second position can be divided into four movement segments that are the first to fourth movement segments, depending on the magnitude of force required for moving the hollow tube 65 by the unit distance. Here, in the embodiment, the difference in the resistance force, which is received by the hollow tube 65 from the cartridge 30, among the second to fourth movement segments in the removing operation is smaller than the difference in the resistance force among the second to fourth movement segments in the inserting operation. Thus, as depicted in FIG. 7C, in a case that the controller 100 judges that the hollow tube 65 is moving through any movement segment among the second to fourth movement segments, the controller 100 drives the driving source 70 at a fourth driving speed, whereas in a case that the controller 100 judges that the hollow tube 65 is moving through the first movement segment, the controller 100 drives the driving source 70 at a fifth driving speed which is slower than the fourth driving speed. In the embodiment, the fourth driving speed is set to be slower than the second driving speed, and the fifth driving speed is set to be the same as the first driving speed.

Note that in the removing operation, regarding the judgement as to whether or not the hollow tube 65 is located to be closer to the side of the first position than the first contact position that is the boundary between the first movement segment and the merged movement segment (whether or not the hollow tube 65 is separated away from the plug 41), the controller 100 judges that the hollow tube 65 is separated away from the plug 41 at a point of time when a plug pass-through time has elapsed since a point of time at which the voltage value of the signal received from the magnetic detection sensor 66 has changed to the maximum voltage value. Note that the term "plug pass-through time" means a time obtained by dividing a control target distance between the first and second contact positions by a movement speed at which the hollow tube 65 is moved under a condition that the driving source 70 is driven at the fourth driving speed. The plug pass-through time is stored in advance in the RAM 123.

Figure 8A:
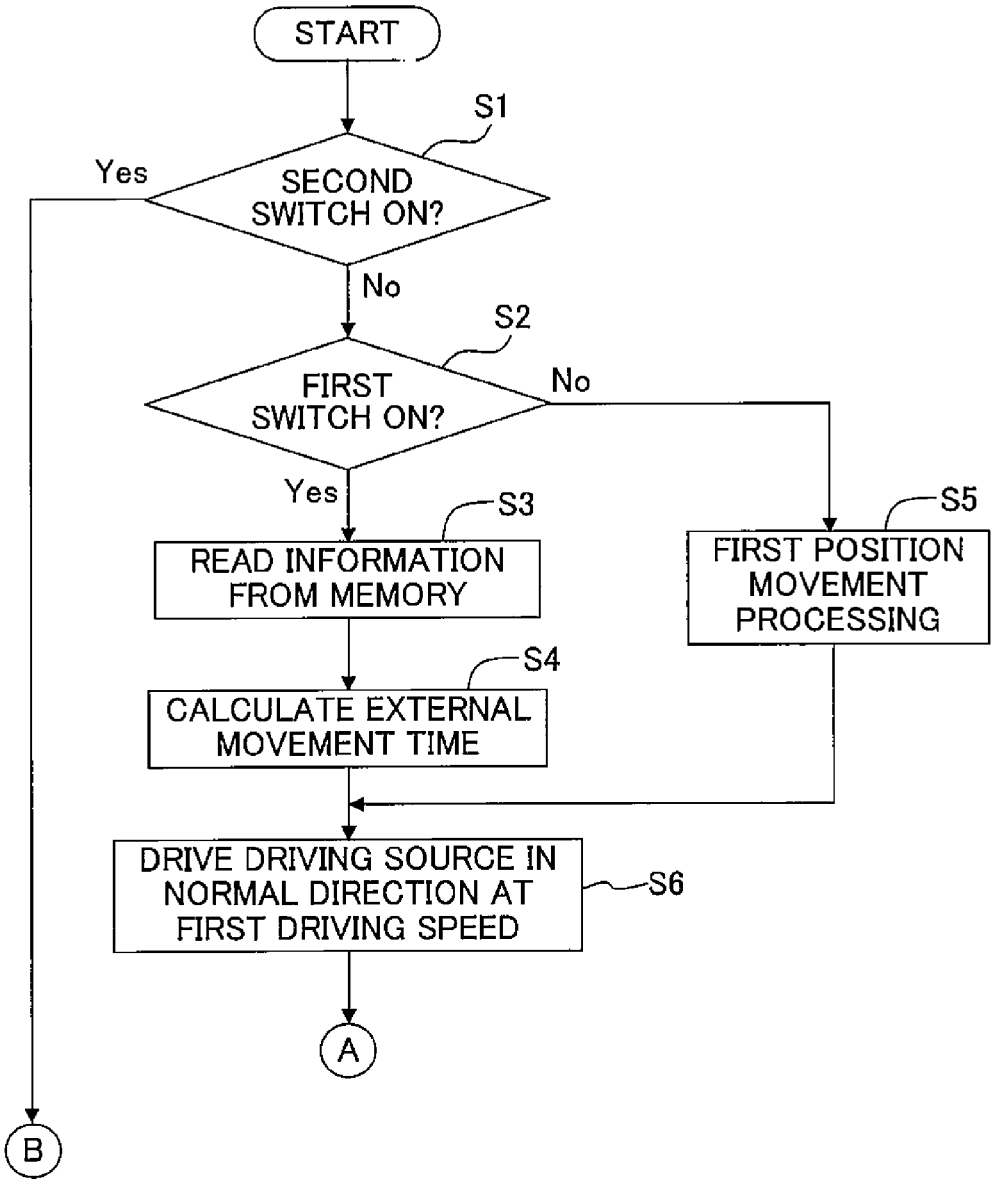
FIGS. 8A and 8B illustrate a flow chart of an operation of the cartridge accommodating apparatus in a case that a cover of the cartridge accommodating apparatus is switched from an open state to a close state.
Figure 8B:
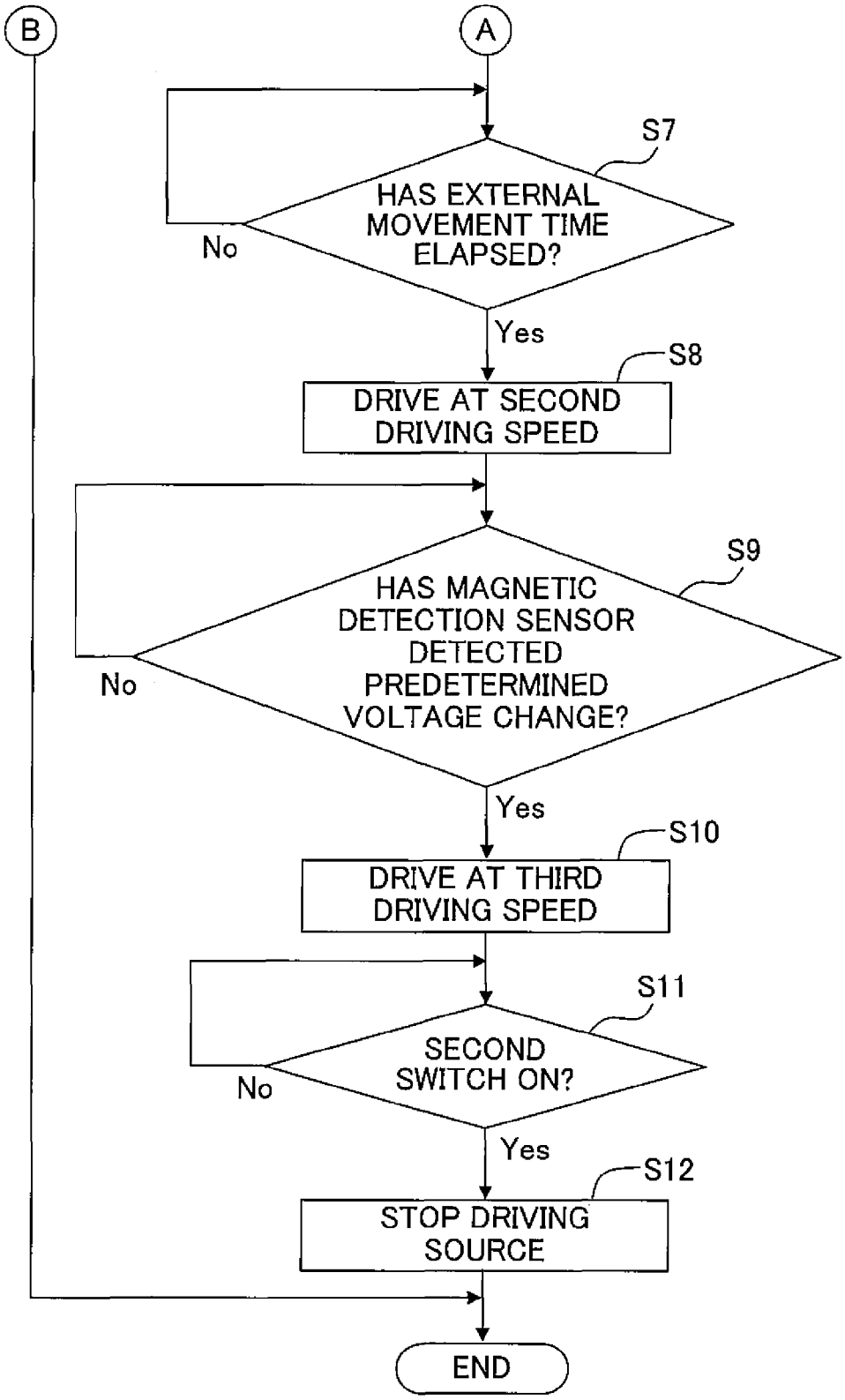

Next, an explanation will be given about an example of an operation performed by the printer 101 in a case that the controller 100 judges that the cover 63 is switched from the ON state to the OFF state based on the signal from the open/close sensor 170, with reference to FIGS. 8A and 8B. At first, the controller 100 judges whether or not the second switch 89 is in the ON state (S1). In a case that the controller 100 judges that the second switch 89 is in the ON state (S1:YES), then the controller 100 judges that the hollow tube 65 is arranged at the second position and that there is no need to perform the inserting operation, and ends this operation. On the other hand, in a case that the controller 100 judges that the second switch 89 is in the OFF state (S1: NO), the controller 100 judges that the inserting operation needs to be executed, and judges whether or not the first switch 88 is in the ON state (S2). In a case that the controller 100 judges that the first switch 88 is in the ON state (S2: YES), the controller 100 judges that a new cartridge 30 is accommodated in the cartridge accommodating section 61, reads the cartridge-side maximum variation from the memory 141 of the new cartridge 30 (S3). Then, the controller 100 determines a control target distance between the first position and the first contact position based on the cartridge-side maximum variation read from the memory 141 and the apparatus-side maximum variation and the designed distance stored in the RAM 123. Further, the controller 100 calculates the external movement time by using the control target distance and stores the calculated external movement time in the RAM 123 (S4). When the processing in Step S4 is finished, the controller 100 then moves onto a processing in Step S6.

On the other hand, in a case that the controller 100 judges that the first switch 88 is in the OFF state (S2: NO), the hollow tube 65 is arranged between the first and second positions. Therefore, the controller 100 executes a first position movement processing for moving the hollow tube 65 to the first position (S5). Specifically, the controller 100 drives the driving source 70 to rotate in the reverse direction until the first switch 88 is switched from the OFF state to the ON state. By doing so, even in such a case that the controller 100 cannot grasp the position of the hollow tube 65, for example, after the operation of the printer 101 has been stopped due to any occurrence of abnormality, etc., it is possible to grasp the position of the hollow tube 65 by returning the hollow tube 65 to the first position. When the processing in Step S5 is finished, the controller 100 then moves onto the processing in Step S6.

In the processing in Step S6, the controller 100 drives the driving source 70 to rotate in the normal direction at the first driving speed, so as to start the movement of the hollow tube 65 from the first position toward the second position. Next, the controller 100 judges whether or not the external movement time stored in the RAM 123 has elapsed since the time of movement of the hollow tube 65 from the first position (S7). In a case that the controller 100 judges that the external movement time has not elapsed (S7: NO), the controller 100 judges that the hollow tube 65 has not reached the first contact position, and repeats the processing in Step S7. On the other hand, in a case that the controller 100 judges that the external movement time has elapsed (S7: YES), then the controller 100 judges that the hollow tube 65 has reached the first contact position, and switches the driving speed of the driving source 70 from the first driving speed to the second driving speed (S8). Next, the controller 100 judges whether or not the signal received from the magnetic detection sensor 66 has changed from the signal indicating the maximum voltage value to a signal indicating the judgment voltage value (S9). In a case that the controller 100 judges that the signal received from the magnetic detection sensor 66 has not changed to the signal indicating the judgement voltage value (S9: NO), the controller 100 judges that the hollow tube 65 has not reached the second contact position (release position), and repeats the processing in Step S9.

On the other hand, in a case that the controller 100 judges that the signal received from the magnetic detection sensor 66 has changed to the signal indicating the judgement voltage value (S9: YES), the controller 100 judges that the hollow tube 65 has reached the second contact position, and switches the driving speed of the driving source 70 from the second driving speed to the third driving speed (S10). Next, the controller 100 judges whether or not the second switch 89 has switched from the OFF state to the ON state (S11). In a case that the controller 100 judges that the second switch 89 is in the OFF state (S11: NO), the controller 100 judges that the hollow tube 65 has not reached the second position, and repeats the processing in Step S11. On the other hand, in a case that the controller 100 judges that the second switch 89 has switched to the ON state (S11: YES), the controller 100 judges that the hollow tube 65 has reached the second position, stops the driving of the driving source 70 (S12), and ends the operation.

Figure 9A:
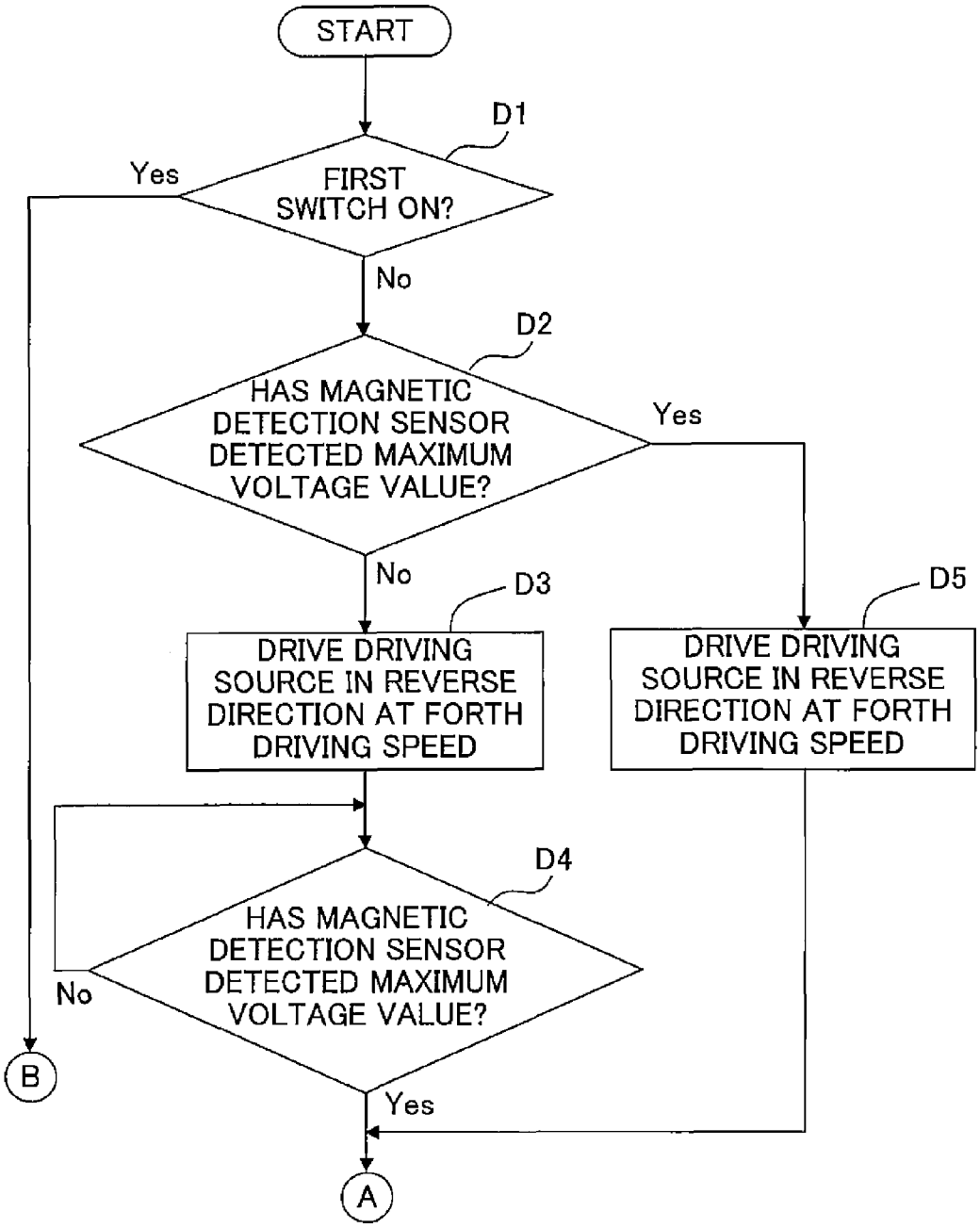
FIGS. 9A and 9B illustrate a flow chart of an operation of the cartridge accommodating apparatus in a case that the cover of the cartridge accommodating apparatus is switched from the close state to the open state.
Figure 9B:
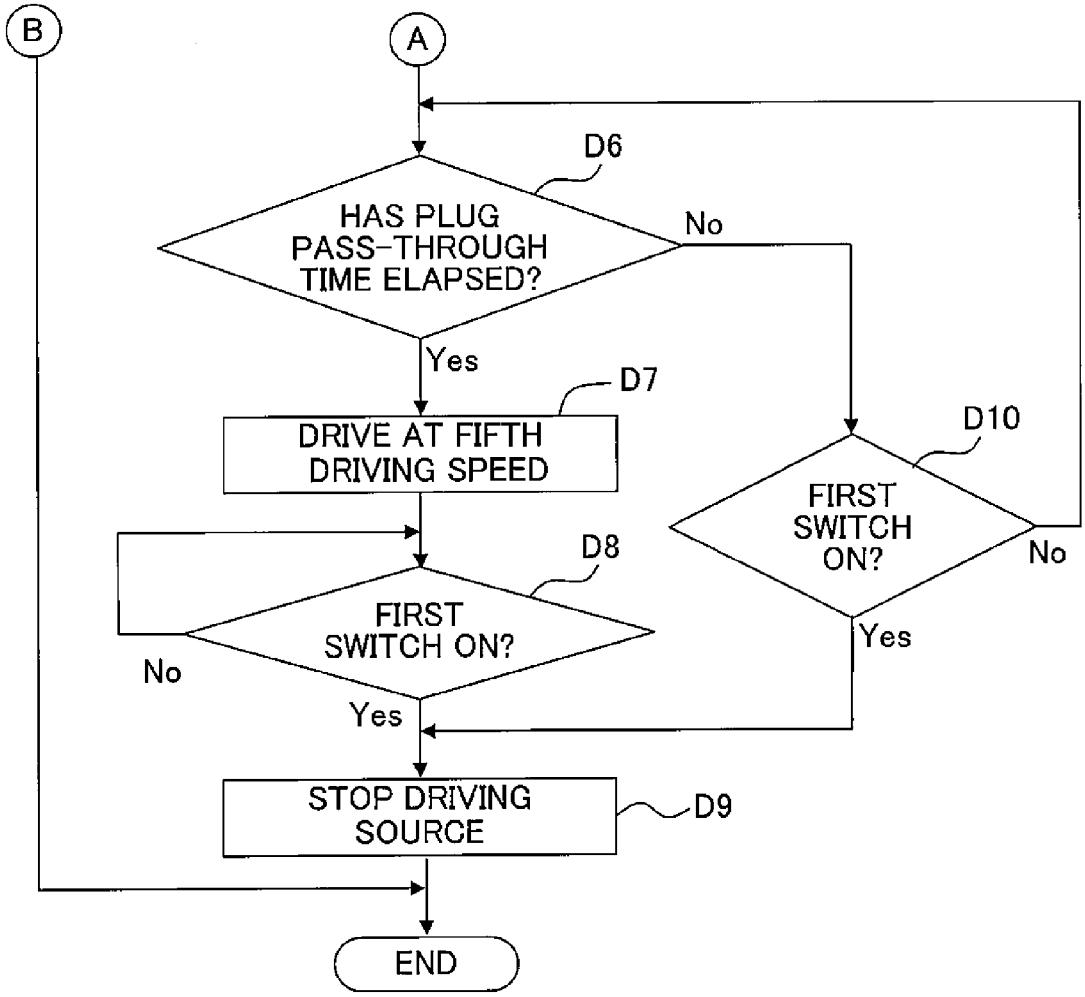

Next, an explanation will be given about an example of an operation performed by the printer 101 in a case that the controller 100 judges that the cover 63 is switched from the close state to the open state based on the signal from the open/close sensor 170, with reference to FIGS. 9A and 9B. At first, the controller 100 judges whether or not the first switch 88 is in the ON state (D1). In a case that the controller 100 judges that the first switch 88 is in the ON state (D1: YES), then the controller 100 judges that there is no need to perform the removing operation, and ends the operation. On the other hand, in a case that the controller 100 judges that the first switch 88 is in the OFF state (D1: NO), the controller 100 judges that the removing operation needs to be executed, and judges whether or not the signal received from the magnetic detection sensor 66 is the signal indicating the maximum voltage value (D2). In a case that the controller 100 judges that the signal received from the magnetic detection sensor 66 is not the signal indicating the maximum voltage value (D2: NO), the controller 100 judges that the hollow tube 65 is arranged at the second position, or at a position between the second position and the second contact position, and the controller 100 drives the driving source 70 to rotate in the reverse direction at the fourth driving speed to thereby move the hollow tube 65 toward the first position (D3). Next, the controller 100 judges whether or not the signal received from the magnetic detection sensor 66 has changed to the signal indicating the maximum voltage value (D4). Then, in a case that the controller 100 judges that the signal received from the magnetic detection sensor 66 has changed to the signal indicating the maximum voltage value (D4: YES), the controller 100 judges that the hollow tube 65 has moved to the second contact position, sets the time at which this judgement has been made (judgement time) to a clocking start time, and moves on to a processing in Step D6.

On the other hand, in a case that the controller 100 judges that the signal received from the magnetic detection sensor 66 is the signal indicating the maximum voltage value (D2: YES), the controller 100 judges that the hollow tube 65 is arranged between the first position and the second contact position. Here, in the embodiment, also in such a case that the controller 100 cannot specify the position of the hollow tube 65, the controller 100 drives the driving source 70 to rotate in the reverse direction at the fourth driving speed so as to move the hollow tube 65 toward the first position (D5). Namely, unlike the inserting operation, the controller 100 does not perform the processing for specifying the position of the hollow tube 65 by moving the hollow tube 65 to the second position. Further, in this situation, the controller 100 sets the time at which the driving of the driving source 70 has started, as the clocking start time. When this processing is finished, the controller 100 moves on to the processing in Step D6.

In the processing in Step D6, the controller 100 judges whether or not the plug pass-through time stored in the RAM 123 has elapsed since the clocking start time set in the processing in Step D4 or D5. In a case that the controller 100 judges that the plug pass-through time has elapsed (D6: YES), the controller 100 judges that the tip portion of the hollow tube 65 is separated away from the plug 41, and the controller 100 switches the driving speed of the driving source 70 from the fourth driving speed to the fifth driving speed (D7). Next, the controller 100 judges whether or not the first switch 88 has switched from the OFF state to the ON state (D8). In a case that the controller 100 judges that the first switch 88 is in the OFF state (D8: NO), the controller 100 repeats the processing in Step D8; on the other hand, in a case that the controller 100 judges that the first switch 88 has switched from the OFF state to the ON state (D8: YES), the controller 100 judges that the hollow tube 65 is arranged at the first position, and the controller 100 stops driving the driving source 70 (D9), and ends the operation.

On the other hand, in a case that the controller 100 judges in the processing of D6 that the plug pass-through time has not elapsed (D6: NO), the controller 100 judges whether or not the first switch 88 has switched from the OFF state to the ON state (D10). In a case that the controller 100 judges that the first switch 88 is in the OFF state (D10: NO), the controller 100 judges that the hollow tube 65 is still arranged between the first and second positions, and returns to the processing in Step D6. On the other hand, in a case that the controller 100 judges that the first switch 88 has switched from the OFF state to the ON state (D10: YES), the controller 100 judges that the hollow tube 65 is arranged at the first position, stops driving the driving source 70 (D9), and ends this operation.

As described above, in each of the cases that the controller 100 of the embodiment judges, in the inserting operation, that the hollow tube 65 is moving in the first movement segment and the fourth movement segment, the controller 100 drives the driving source 70 at the driving speed slower than the second driving speed at which the driving source 70 is driven in the merged movement segment. By doing so, it is possible to make the operation sound generated from the driving force transmitting mechanism 75 be small during a period of time in which the hollow tube 65 is moving in each of the first movement segment and the fourth movement segment. Further, in a case that the controller 100 judges, in the removing operation, that the hollow tube 65 is moving in the first movement segment, the controller 100 drives the driving source 70 at the driving speed slower than the fourth driving speed at which the driving source is driven in each of the second to fourth movement segments. By doing so, it is possible to make the operation sound generated from the driving force transmitting mechanism 75 be small during a period of time in which the hollow tube 65 is moving in the first movement segment. Furthermore, the controller 100 of the embodiment determines the control target distance in view of the cartridge-side maximum variation of the first contact position and the apparatus-side maximum variation of each of the first position and the first contact position, and the controller 100 calculates the exterior movement time by using the control target distance. By doing so, it is possible to make the difference in time be small between the time at which the exterior movement time has elapsed since the movement start time and the actual time (actual reach time) at which the hollow tube 65 actually reaches the first contact position. As a result, the driving source 70 can be driven at the driving speed depending on (in conformity with) the movement segment in which the hollow tube 65 is actually moving. Moreover, the controller 100 of the embodiment judges whether or not the hollow tube 65 has reached the second contact position (release position), based on the signal received from the magnetic detection sensor 66 configured to detect the intensity of the magnetic field which changes depending on the distance between the magnetic detection sensor 66 and the valve body 52 of the second blocking member 50. Thus, the controller 100 is capable of judging in an assured manner that the hollow tube 65 has reached the second contact position (release position).

Figure 10A:
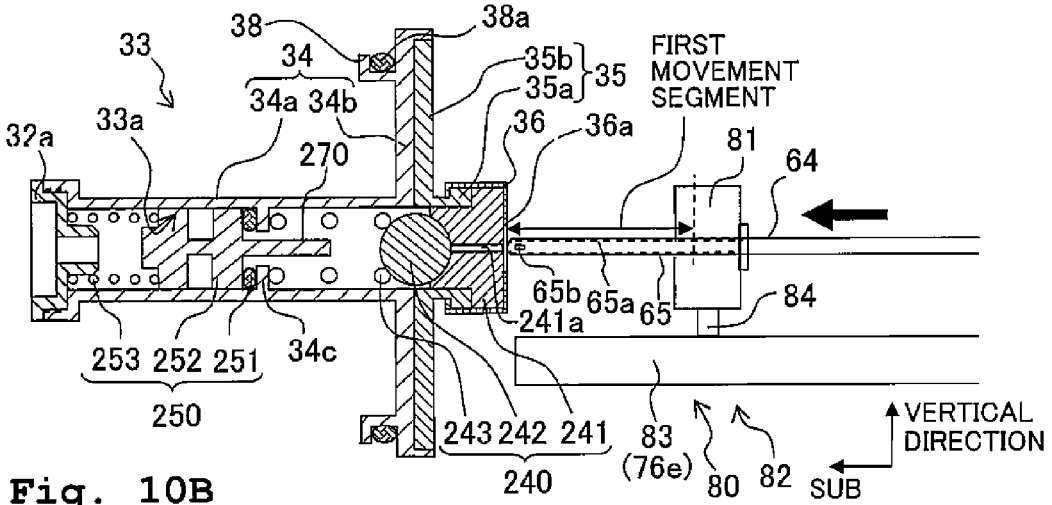

In the foregoing, the suitable embodiment of the present teaching has been explained. The present teaching, however, is not limited to the above-described embodiment, and it is possible to make any appropriate changes in the embodiment of the present teaching within the range of the description in the following claims. In the following, an explanation will be given about a cartridge accommodating apparatus configured to accommodate another cartridge, with reference to FIGS. 10A to 10C. The another cartridge has a substantially same configuration as that of the cartridge 30, except for having first and second blocking members 240 and 250 which are different from the first and second blocking members 40 and 50 of the cartridge 30, and the remaining parts or components, of the another cartridge, other than the first and second blocking members 240 and 250 are substantially same as those of the cartridge 30. The first blocking member 240 has a plug 241, a spherical body 242 and a coil spring 243. The plug 241 is provided to block or close an opening in the other end of a tube 35, similarly to the above-described plug 41, and the plug 241 has a slit 241*a* penetrating through a central portion of the plug 241 in the sub scanning direction. In a case that the first blocking member 240 is in the close state as depicted in FIG. 10A, the spherical body 242 is brought into tight contact with the plug 241 so as to block the slit 241*a* with the spherical body 242, thereby blocking (cutting off) the communication between the ink channel 33*a* and the outside of the ink channel 33*a*. The coil spring 243 has the base end which is fixed to an annular-shaped projection 34*c*, and the forward end (distal end) which makes contact with the spherical body 242, thereby urging the spherical body 242 toward the plug 241 at all times.

The second blocking member 250 is arranged inside a tube 34, and has an O-ring 251, a valve body 252 and a coil spring 253. Further, the valve body 252 has a stick-shaped pressing member 270 which is disposed in a central portion on a surface, of the valve body 252, facing the first blocking member 240, and which extends in the sub scanning direction. The pressing member 270 has the diameter that is smaller than the diameter of an opening defined by the annular-shaped projection 34*c*, and the pressing member 270 is inserted inside the opening defined by the annular-shaped projection 34*c*. Further, in a state that the hollow tube 65 does not reach the second contact position (see FIG. 10C), the end portion of the pressing member 270 is separated away from the spherical body 242. The O-ring 251 is fixed to a surface, of the annular-shaped projection 34, on the side not facing the first blocking member 240. The coil spring 253 has the base end fixed to a connecting section 32*a* of the ink bag 32 and the forward end (distal end) brought into contact with the valve body 252, thereby urging the valve body 252 toward the O-ring 251 at all times. Accordingly, in a case that the second blocking member 250 is in the close state wherein the second blocking member 250 closes (blocks) the ink channel 33*a*, the valve body 252 makes contact with the O-ring 251. With this, the communication is blocked between the space, in the ink channel 33*a*, from the one end of the tube 34 to the O-ring 251 and another space, in the ink channel 33*a*, from the O-ring 251 to the first blocking member 240, which in turn blocks the communication between the ink bag 32 and the outside of the ink bag 32, via the ink channel 33*a*.

Figure 10B:
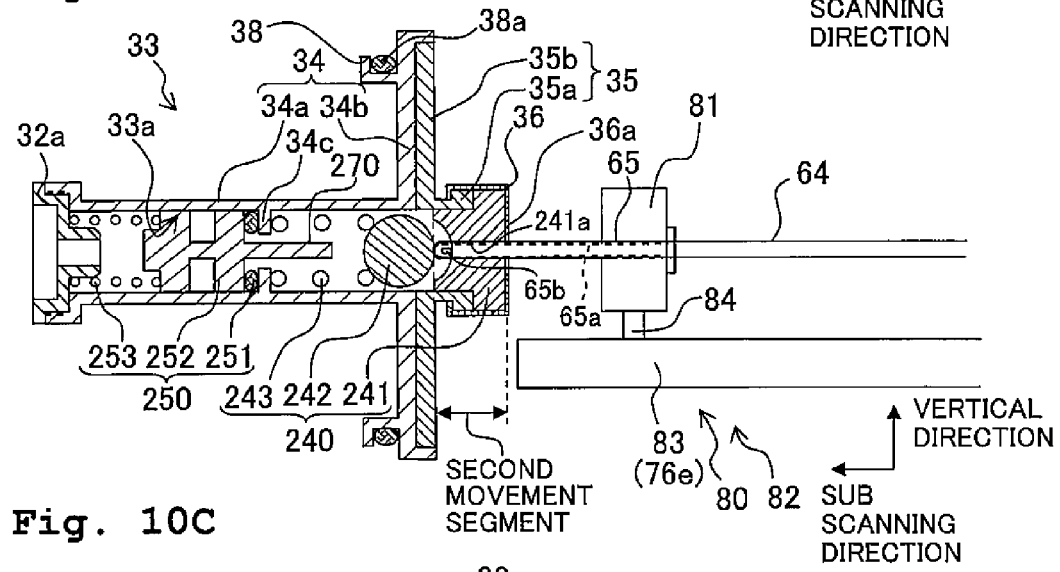
Figure 10C:
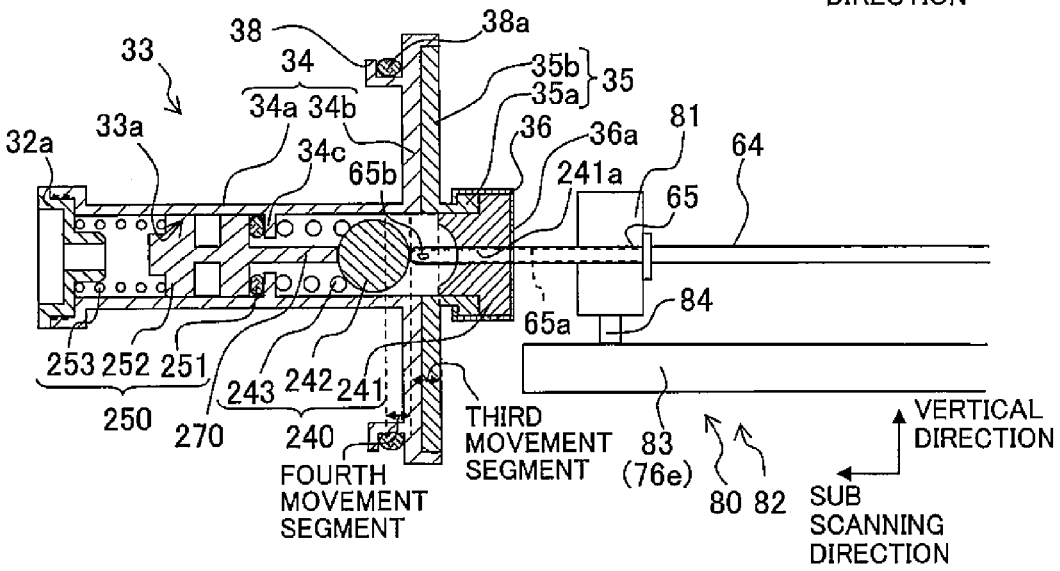

Accompanying with the start of movement of the hollow tube 65 from the first position to the second position, at first, as depicted in FIG. 10B, the hollow tube 65 is inserted into the slit 241*a*. Further, the hollow tube 65 moves the spherical body 242 in a state that the tip portion of the hollow tube 65 is brought into contact with the spherical body 242, thereby separating the spherical body 242 away from the plug 241. In this situation, the hollow tube 65 is arranged at the release position, which in turn switches the first blocking member 240 from the close state to the open state. Further, after the spherical body 242 has been separated away from the plug 241, the spherical body 242 is brought into contact with the end portion of the pressing member 270 (see FIG. 10C). Furthermore, when the hollow tube 65 advances (enters) farther into the ink channel 33*a*, the pushing member 270 is moved, which in turn causes the valve body 252 to separate away from the O-ring 251. In this situation, the second blocking member 250 is switched from the close state to the open state.

Note that in this aspect, the phrase that "the tip portion of the hollow tube 65 is brought into contact (makes contact) with the second blocking member 250" corresponds to a situation or state that the hollow tube 65 is brought into contact (makes contact) with the end portion of the pressing member 270 via the spherical body 242. Further, in the embodiment, the resistance force received by the hollow tube 65 from the first blocking member 240 when the hollow tube 65 releases (opens) the first blocking member 240 is smaller than the resistance force received by the hollow tube 65 from the second blocking member 250 when the hollow tube 65 releases the second blocking member 250. Accordingly, the third driving speed of the driving source 70 corresponding to the fourth movement segment between the second contact position and the second position is set to be faster than the second driving speed of the driving source 70 corresponding to the second movement segment. Further, in this aspect, the third movement segment is a distance same as the spacing distance (clearance) between the pressing member 270 and the spherical body 242, and is longer than that in the above-described embodiment. Accordingly, the controller 100 is configured to further judge whether or not the hollow tube 65 is moving in the third movement segment. Further, in a case that the controller 100 judges that the hollow tube 65 is moving in the third movement segment, the controller 100 may drive the driving source 70 at a driving speed slower than the second driving speed.

In the following, other modifications will be explained. In the above-described embodiment, the controller 100 judges, in the inserting operation, whether or not the hollow tube 65 has reached the first contact position, based on the elapsed time elapsed since a point of time at which the hollow tube 65 has been moved from the first position. The present teaching, however, is not limited particularly to this. For example, the controller 100 is allowed to make the judgement based on the pulse count of the driving motor as the driving source 70. Further, in the embodiment, the controller 100 judges, in the inserting operation, whether or not the hollow tube 65 has reached the release position (second contact position) by detecting, with the magnetic detection sensor 66, the strength of the magnetic field which changes as the hollow tube 65 is moved from the release position toward the second position. The present teaching, however, is not limited particularly to this. For example, it is also allowable to provide a sensor configured to detect whether or not the hollow tube 65 is arranged at the release position (for example, a transmission-type sensor, a sensor of the mechanical switch type, etc.), and the controller 100 is allowed to make the judgement based on a result of detection by this sensor. Furthermore, the controller is allowed to make judgment as to whether or not the hollow tube 65 has reached the release position (second contact position), based on an elapsed time elapsed since a point of time at which the controller 100 has judged that the hollow tube 65 has reached the first contact position. Specifically, it is allowable that the controller 100 judges that the hollow tube 65 has reached the release position at a point of time at which the plug pass-through time (second time; second period of time) has elapsed since a point of time at which the controller 100 has judged that the hollow tube 65 has reached the first contact position. Note that the plug pass-through time is a time obtained by dividing a control target distance between the first contact position and the release position by a movement speed of the hollow tube 65 under a condition that the driving source 70 is driven at the second driving speed. Moreover, although the moving member as the target detection member for the magnetic detection sensor 66 is the valve body 52 of the second blocking member 50, the present teaching is not limited particularly to this. It is allowable that the moving body as the target detection member is a member, part or component which is different from any constituent part or component of the second blocking member 50. Furthermore, although the embodiment is configured such that the exterior movement time is calculated under a condition that a new cartridge 30 is accommodated in the cartridge accommodating section 60 and then the calculated exterior movement time is stored in the RAM 123, it is also allowable that an assumed exterior movement time is stored in advance in the RAM 123.

Further, in the embodiment, although the explanation has been given about the cartridge wherein the resistance force received by the hollow tube 65 from the first blocking member 40 when the hollow tube 65 releases the first blocking member 40 is different from the resistance force received by the hollow tube 65 from the second blocking member 50 when the hollow tube 65 releases the second blocking member 50, it is allowable to provide a cartridge wherein these resistance forces are same with each other. In such a case, the second driving speed corresponding to the second movement segment is same as the third driving speed corresponding to the fourth movement segment. Furthermore, although the embodiment is configured such that, in the removing operation, the driving speeds corresponding to the second to fourth movement segments, respectively, are set to be mutually same, it is allowable to set the moving speeds to be different among the second to fourth segments, depending on the force required for moving the hollow tube 65 by the unit distance for each of the second to fourth movement segments. Moreover, in the embodiment, since the through hole is already formed in the plug 41 in a case that the inserting operation is to be executed for the second time for the same cartridge 30, the driving speed in the merged movement segment (second movement segment) may be slower than the driving speed in the merged movement segment (second movement segment) adopted when the inserting operation was executed for the first time.

Moreover, in the embodiment, although the driving force transmitting mechanism is constructed of the gears 76*a* to 76*e*, the driving force transmitting mechanism is not particularly limited to the above configuration, provided that the driving force of the driving source can be transmitted to the moving mechanism. For example, the driving force transmitting mechanism may be configured such that the first gear is directly meshed with the second gear, or such that the driving force is transmitted via a belt.

The liquid to be stored or accommodated in the cartridge is not limited to an ink. For example, the liquid may be an image quality-improving liquid, etc., which is applied to (coated on) a recording paper P before performing printing thereon, for the purpose of improving the image quality. The cartridge accommodating apparatus according to the present teaching is not limited to a printer, and the present teaching may be applied to a facsimile machine, a copying machine, etc.

What is claimed is:

1. A cartridge accommodating apparatus comprising:

a cartridge accommodating section configured to accommodate a cartridge which includes a liquid accommodating section configured to accommodate liquid, a liquid lead-out channel communicated with the liquid accommodating section and configured to lead the liquid to outside of the liquid accommodating section, a first blocking member configured to block a first portion of the liquid lead-out channel, and a second blocking member configured to block a second portion, of the liquid lead-out channel, between the first portion of the liquid lead-out channel and the liquid accommodating section;

a hollow tube configured to introduce the liquid, in the liquid lead-out channel of the cartridge, into inside of the hollow tube;

a moving mechanism configured to move the hollow tube between a first position at which a tip portion of the hollow tube is located outside the liquid lead-out channel of the cartridge accommodated in the cartridge accommodating section and a second position at which the tip portion of the hollow tube has entered inside the liquid lead-out channel of the cartridge and the hollow tube is communicated with the liquid accommodating section of the cartridge;

a driving source;

a driving force transmitting mechanism configured to transmit driving force of the driving source to the moving mechanism; and a driving source controller configured to control driving speed of the driving source, wherein the driving source controller is configured to:

drive the driving source at a first driving speed, after causing the hollow tube to move from the first position and until judging that the tip portion of the hollow tube has reached a first contact position at which the tip portion of the hollow tube makes contact with the first blocking member;

drive the driving source at a second driving speed which is faster than the first driving speed, after judging that the tip portion of the hollow tube has reached the first contact position and until judging that the tip portion of the hollow tube has reached a release position at which the tip portion of the hollow tube releases the first blocking member; and drive the driving source at a third speed, after judging that the tip portion of the hollow tube has reached a second contact position at which the tip portion of the hollow tube makes contact with the second blocking member.

2. The cartridge accommodating apparatus according to claim 1, wherein the third driving speed is faster than the first and second driving speeds, in a case that resistance force received by the hollow tube from the second blocking member under a condition that the hollow tube releases the second blocking member is greater than resistance force received by the hollow tube from the first blocking member under a condition that the hollow tube releases the first blocking member, and the third driving speed is faster than the first driving speed and is slower than the second driving speed, in a case that the resistance force received by the hollow tube from the second blocking member under the condition that the hollow tube releases the second blocking member is smaller than the resistance force received by the hollow tube from the first blocking member under the condition that the hollow tube releases the first blocking member.

3. The cartridge accommodating apparatus according to claim 1, wherein the driving source is a driving motor having a rotation shaft, the driving force transmitting mechanism has a first gear connected to the rotation shaft of the driving motor, and a second gear meshed with the first gear directly or indirectly, and the moving mechanism is provided with a converting mechanism configured to convert a rotation operation of the second gear to a moving operation for moving the hollow tube between the first and second positions.

4. The cartridge accommodating apparatus according to claim 1, wherein in a case that the driving source controller causes the hollow tube to move from the second position to the first position, the driving source controller is configured to:

drive the driving source at a fourth driving speed, in a case of judging that the tip portion of the hollow tube is not separated away from the first blocking member; and drive the driving source at a fifth driving speed which is slower than the fourth driving speed, in a case of judging that the tip portion of the hollow tube is separated away from the first blocking member.

5. The cartridge accommodating apparatus according to claim 1, wherein the driving source controller is configured to judge that the hollow tube has reached the first contact position at a point of time at which a first time has elapsed since the driving source has been driven and the hollow tube has been moved from the first position, and the first time is determined based on a first control target distance between the first position and the first contact position and a moving speed at which the hollow tube is moved under a condition that the driving source is driven at the first driving speed.

6. The cartridge accommodating apparatus according to claim 5, wherein the first control target distance is determined based on a designed distance between the first position and the first contact position, variation of the first position presumed at the time of manufacturing the cartridge accommodating apparatus, variation of the first contact position presumed at the time of manufacturing the cartridge, and variation of the first contact position presumed at the time of manufacturing the cartridge accommodating apparatus.

7. The cartridge accommodating apparatus according to claim 5, further comprising a cartridge accommodating apparatus-side memory, wherein the cartridge further includes a cartridge-side memory configured to store variation of the first contact position presumed at the time of manufacturing the cartridge, the driving source controller is configured to:

read the variation of the first contact position stored in the cartridge-side memory;

store, in the cartridge accommodating apparatus-side memory, a designed distance between the first position and the first contact position, variation of the first position presumed at the time of manufacturing the cartridge accommodating apparatus, and variation of the first contact position presumed at the time of manufacturing the cartridge accommodating apparatus;

determine the first control target distance based on the variation of the first contact position read from the cartridge-side memory, and based on the designed distance, the variation of the first position and the variation of the first contact position which are stored in the cartridge accommodating apparatus-side memory; and calculate the first time based on the first control target distance and the moving speed at which the hollow tube is moved under a condition that the driving source is driven at the first driving speed.

8. The cartridge accommodating apparatus according to claim 1, wherein the driving source controller is configured to judge that the hollow tube has reached the release position at a point of time at which a second time has elapsed since a point of time at which the controller has judged that the hollow tube has reached the first contact position, and the second time is determined based on a second control target distance between the first contact position and the release position and a moving speed at which the hollow tube is moved under a condition that the driving source is driven at the second driving speed.

9. The cartridge accommodating apparatus according to claim 1, wherein the cartridge is further provided with a sensor configured to detect whether or not the hollow tube is arranged at the release position, or configured to detect an information which changes as the hollow tube is moved from the release position toward the second position, and the driving source controller is further configured to:

receive a result of detection executed by the sensor; and judge whether or not the hollow tube has reached the release position based on the received result of the detection executed by the sensor.

10. The cartridge accommodating apparatus according to claim 9, wherein the cartridge further includes a movable body which is formed of a magnetic material, which is disposed to be movable in a predetermined range between the first portion inside the liquid lead-out channel and the liquid accommodating section, and which is configured to move by being pushed by the hollow tube at least during a partial period included in a period during which the hollow tube is moved from the release position to the second position, and the sensor is a magnetic detection sensor configured to detect a magnetic field which changes as the movable body moves inside the liquid lead-out channel.

11. The cartridge accommodating apparatus according to claim 10, wherein resistance force received by the hollow tube from the second blocking member when the hollow tube releases the second blocking member is smaller than resistance force received by the hollow tube from the first blocking member when the hollow tube releases the first blocking member, the second blocking member is a valve member including:

a valve body constructed of the movable member;

an urging member configured to urge the valve body toward a lead-out port of the liquid lead-out channel; and a valve seat having an opening, which is blocked under a condition that the valve body is brought into contact with the opening and which is released under a condition that the valve body is separated away from the opening, and the driving source controller is configured to judge whether or not the hollow tube has reached the second contact position based on a result of detection executed by the magnetic detection sensor.

12. The cartridge accommodating apparatus according to claim 10, wherein the driving source controller is configured to judge that the hollow tube has reached the release position at a point of time at which an amount of change of the magnetic field, detected by the magnetic detection sensor since a point of time at which the driving source controller has judged that the hollow tube has reached the first contact position, becomes not less than a predetermined amount.

* * * * *